US010539897B2

(12) United States Patent
Motani et al.

(10) Patent No.: US 10,539,897 B2
(45) Date of Patent: Jan. 21, 2020

(54) IMAGE FORMING METHOD AND TONER SET FOR DEVELOPING ELECTROSTATIC LATENT IMAGE

(71) Applicant: Konica Minolta Inc., Tokyo (JP)

(72) Inventors: Hitomi Motani, Hino (JP); Tomoko Mine, Hino (JP); Kaori Matsushima, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/163,046

(22) Filed: Oct. 17, 2018

(65) Prior Publication Data

US 2019/0137899 A1 May 9, 2019

(30) Foreign Application Priority Data

Nov. 7, 2017 (JP) ..... 2017-214447

(51) Int. Cl.

| | |
|---|---|
| ***G03G 9/087*** | (2006.01) |
| ***G03G 9/097*** | (2006.01) |
| ***G03G 9/08*** | (2006.01) |
| ***G03G 9/09*** | (2006.01) |

(52) U.S. Cl.

CPC ..... *G03G 9/08764* (2013.01); *G03G 9/0804* (2013.01); *G03G 9/0819* (2013.01); *G03G 9/08791* (2013.01); *G03G 9/08795* (2013.01); *G03G 9/08797* (2013.01); *G03G 9/0926* (2013.01); *G03G 9/09708* (2013.01); *G03G 9/09725* (2013.01)

(58) Field of Classification Search

CPC ..... G03G 9/08764; G03G 9/08791; G03G 9/08797; G03G 9/09708; G03G 9/0804; G03G 9/08795

See application file for complete search history.

(56) References Cited

U.S. PATENT DOCUMENTS

2009/0142680 A1* 6/2009 Shimota ..... G03G 9/0806 430/107.1

FOREIGN PATENT DOCUMENTS

JP 2017009972 A 1/2017

* cited by examiner

*Primary Examiner* — Thorl Chea

(74) *Attorney, Agent, or Firm* — Lucas & Mercanti, LLP

(57) ABSTRACT

An image forming method uses a color toner including a yellow toner, a magenta toner, a cyan toner, and a black toner. The image forming method includes a toner image forming step of forming a toner image by developing the color toner on an electrostatic latent image formed by charging and exposing a surface of an electrostatic latent image bearing member, a transfer step of transferring the toner image onto a recording medium to form a color toner image, and a fixing step of fixing the color toner image on the recording medium. Each toner contain at least a binder resin, a coloring agent, a release agent, and a layered silicate compound. The volume average particle diameter of each toner is 4 to 6 μm. The content of the aluminum element in each toner represented by the Net intensity by WDXRF analysis has a specific relationship.

6 Claims, No Drawings

IMAGE FORMING METHOD AND TONER SET FOR DEVELOPING ELECTROSTATIC LATENT IMAGE

CROSS-REFERENCE TO RELATED APPLICATION

The entire disclosure of Japanese Patent Application No. 2017-214447, filed on Nov. 7, 2017, is incorporated herein by reference in its entirety.

BACKGROUND

1. Technical Field

The present invention relates to an image forming method and a toner set for developing an electrostatic latent image.

2. Description of Related Arts

In recent years, from the viewpoint of environmental safety, energy saving, and reduction of waste, it is required to reduce the use amount of electrostatic latent image developing toner (hereinafter also simply referred to as "toner") used for electrophotographic image formation. One of the techniques for achieving the reduction in use amount is to reduce the diameter of the toner. By reducing the diameter of the toner, it is possible to reduce the thickness of the toner on the image and it is possible to reduce the amount of toner used. Further, by reducing the diameter of the toner, image defects such as fog on the image are suppressed, thin line reproducibility is improved, and image quality is also improved.

However, when the diameter of the toner is reduced, the number of cases of slipping through a cleaning means is increased, breakage such as chipping occurs in a cleaning member, and defects such as the image defects occur due to uneven wear of a photosensitive member by the cleaning member and poor charging due to a slipped toner.

As a technique for solving such a problem, there is a heterogeneous toner. When the toner is made heterogeneous, the fluidity of the toner is lowered, and the adhesive force between the toner and the cleaning member is increased, thereby improving the cleaning performance of the toner.

As a means for making the diameter-reduced toner heterogeneous, there is a technique for adding a layered inorganic compound to the toner (see, for example, JP 2017-9972 A). Since the layered inorganic compound can exist in the vicinity of the surface layer of the toner, a binder resin in the vicinity of the toner surface layer thickens, it is possible to make the toner heterogeneous appropriately, it is easy to adjust the chargeability of the toner, and the charging stability is also improved.

SUMMARY

However, in the technique disclosed in JP 2017-9972 A, the difference in the charge amount between the toners of the respective colors becomes large at the time of long-term use, the charging stability decreases, and the color reproducibility of the color image is deteriorated.

It is an object of the present invention to provide a means for reducing the difference in charge amount between toners of respective colors at the time of initial use and long-term use and improving the color reproducibility of a color image at the time of long-term use.

The present inventors have keenly studied. As a result, it was found that the above object could be solved by the following image forming method, and the present invention has been completed.

To achieve at least one of the abovementioned objects, according to an aspect of the prevent invention, an image forming method using a color toner including a yellow toner, a magenta toner, a cyan toner, and a black toner, reflecting one aspect of the present invention, includes: a toner image forming step of forming a toner image by developing the color toner on an electrostatic latent image formed by charging and exposing a surface of an electrostatic latent image bearing member; a transfer step of transferring the toner image onto a recording medium to form a color toner image; and a fixing step of fixing the color toner image on the recording medium, wherein the yellow toner, the magenta toner, the cyan toner, and the black toner each contain at least a binder resin, a coloring agent, a release agent, and a layered silicate compound, a volume average particle diameter of the yellow toner, the magenta toner, the cyan toner and the black toner is 4 μm to 6 μm, and when Al (Y) (unit: kcps) is the content of aluminum element in the yellow toner expressed by Net intensity by wavelength dispersion type fluorescent X-ray analysis, Al (M) (unit: kcps) is the content of aluminum element in the magenta toner expressed by Net intensity by wavelength dispersion type fluorescent X-ray analysis, Al (C) (unit: kcps) is the content of aluminum element in the cyan toner expressed by Net intensity by wavelength dispersion type fluorescent X-ray analysis, and Al (K) (unit: kcps) is the content of aluminum element in the black toner expressed by Net intensity by wavelength dispersion type fluorescent X-ray analysis, the following Formulae (1) to (3) are satisfied.

[Math. 1]

$$\mathrm{Al}(Y)<\mathrm{Al}(M)<\mathrm{Al}(C) \quad (1)$$

$$\mathrm{Al}(Y)<\mathrm{Al}(K)<\mathrm{Al}(C) \quad (2)$$

$$3.18<[\mathrm{Al}(C)-\mathrm{Al}(Y)]<8.65 \quad (3)$$

In addition, the inventors of the present invention have found that the above problems can be solved by the following toner set for developing electrostatic latent images, and have completed the present invention.

To achieve at least one of the abovementioned objects, according to an aspect of the prevent invention, a toner set for electrostatic latent image reflecting one aspect of the present invention is a toner set for developing an electrostatic latent image including a yellow toner, a magenta toner, a cyan toner, and a black toner, wherein the yellow toner, the magenta toner, the cyan toner, and the black toner each contain at least a binder resin, a coloring agent, a release agent, and a layered silicate compound, a volume average particle diameter of the yellow toner, the magenta toner, the cyan toner and the black toner is 4 μm to 6 μm, and when Al (Y) (unit: kcps) is the content of aluminum element in the yellow toner expressed by Net intensity by wavelength dispersion type fluorescent X-ray analysis, Al (M) (unit: kcps) is the content of aluminum element in the magenta toner expressed by Net intensity by wavelength dispersion type fluorescent X-ray analysis, Al (C) (unit: kcps) is the content of aluminum element in the cyan toner expressed by Net intensity by wavelength dispersion type fluorescent X-ray analysis, and Al (K) (unit: kcps) is the content of aluminum element in the black toner expressed by Net intensity by wavelength dispersion type fluorescent X-ray analysis, the following Formulae (1) to (3) are satisfied.

[Math. 2]

$$Al(Y)<Al(M)<Al(C) \quad (1)$$

$$Al(Y)<Al(K)<Al(C) \quad (2)$$

$$3.18<[Al(C)-Al(Y)]<8.65 \quad (3)$$

DETAILED DESCRIPTION OF THE EMBODIMENT

Hereinafter, one or more embodiments of the present invention will be described. However, the scope of the present invention is not limited to the disclosed embodiments.

A first embodiment of the present invention is an image forming method using a color toner including a yellow toner, a magenta toner, a cyan toner, and a black toner. The image forming method according to the present embodiment includes a toner image forming step of forming a toner image by developing the color toner on an electrostatic latent image formed by charging and exposing a surface of an electrostatic latent image bearing member, a transfer step of transferring the toner image onto a recording medium to form a color toner image, and a fixing step of fixing the color toner image on the recording medium. The yellow toner, the magenta toner, the cyan toner, and the black toner each contain at least a binder resin, a coloring agent, a release agent, and a layered silicate compound. The volume average particle diameter of the yellow toner, the magenta toner, the cyan toner, and the black toner is 4 μm to 6 μm. When Al (Y) (unit: kcps) is the content of aluminum element in the yellow toner expressed by Net intensity by wavelength dispersion type fluorescent X-ray analysis, Al (M) (unit: kcps) is the content of aluminum element in the magenta toner expressed by Net intensity by wavelength dispersion type fluorescent X-ray analysis, Al (C) (unit: kcps) is the content of aluminum element in the cyan toner expressed by Net intensity by wavelength dispersion type fluorescent X-ray analysis, and Al (K) (unit: kcps) is the content of aluminum element in the black toner expressed by Net intensity by wavelength dispersion type fluorescent X-ray analysis, the following Formulae (1) to (3) are satisfied.

[Math. 3]

$$Al(Y)<Al(M)<Al(C) \quad (1)$$

$$Al(Y)<Al(K)<Al(C) \quad (2)$$

$$3.18<[Al(C)-Al(Y)]<8.65 \quad (3)$$

In addition, another embodiment of the present invention is a toner set for developing an electrostatic latent image including a yellow toner, a magenta toner, a cyan toner, and a black toner. The yellow toner, the magenta toner, the cyan toner, and the black toner each contain at least a binder resin, a coloring agent, a release agent, and a layered silicate compound. The volume average particle diameter of the yellow toner, the magenta toner, the cyan toner, and the black toner is 4 μm to 6 μm. When Al (Y) (unit: kcps) is the content of aluminum element in the yellow toner expressed by Net intensity by wavelength dispersion type fluorescent X-ray analysis, Al (M) (unit: kcps) is the content of aluminum element in the magenta toner expressed by Net intensity by wavelength dispersion type fluorescent X-ray analysis, Al (C) (unit: kcps) is the content of aluminum element in the cyan toner expressed by Net intensity by wavelength dispersion type fluorescent X-ray analysis, and Al (K) (unit: kcps) is the content of aluminum element in the black toner expressed by Net intensity by wavelength dispersion type fluorescent X-ray analysis, the following Formulae (1) to (3) are satisfied.

[Math. 4]

$$Al(Y)<Al(M)<Al(C) \quad (1)$$

$$Al(Y)<Al(K)<Al(C) \quad (2)$$

$$3.18<[Al(C)-Al(Y)]<8.65 \quad (3)$$

The term "toner set" as used herein refers to a toner combination that forms different image forming layers when transferred onto a recording medium.

According to the image forming method of the present invention, it is possible to reduce the difference in charge amount between the toners of the respective colors at the time of initial use and the long-term use and to improve the color reproducibility of the color image at the time of long-term use. In addition, the same effect as described above can be obtained by using the toner set for developing electrostatic latent images according to the present invention. Although the mechanism of action by which the above effect can be obtained by such constitution of the present invention is unknown, it is thought as follows.

As one means for solving the reduction in the amount of toner used, which has been demanded in recent years, there is a reduction in toner diameter. However, since the cleaning performance of the toner deteriorates, attempts have been made to improve the cleaning performance by adding the layered inorganic compound to the toner to make the toner heterogeneous, as in the technique disclosed in JP 2017-9972 A. In addition, the adjustment of the charge amount of the toner is made easy by adding the layered inorganic compound, and it is said that the charge stability is effective.

However, since the small-diameter toner has a large surface area, the influence of the charge amount change due to the addition of the layered inorganic compound increases. In particular, in the color toners including the yellow toner, the magenta toner, the cyan toner, and the black toner, the chargeability of each coloring agent is different. Since the charge amount of toner particles varies, there was a problem that the charging stability of the toner and the color reproducibility in the color image are deteriorated for a long period of use.

As a result of intensive research, the inventors of the present invention have found that the problem could be solved by satisfying the relationship of the above Formulae (1) to (3) with respect to the content of aluminum element in the toner of each color.

In the yellow toner, the magenta toner, the cyan toner, and the black toner, there is a tendency that the charge amount of the black toner and the cyan toner is higher than the charge amount of the yellow toner and the magenta toner due to the influence of the chargeability of the coloring agent. In the present invention, for each color toner, it is possible to reduce the difference in the charge amount between the toners of the respective colors and improve the charging stability by setting the content of the aluminum element which suppresses the excessive charging of the toner to the relationship of the above-mentioned Formulae (1) to (3). In addition, due to this, it is possible to stably maintain the developability and transferability of the toner of each color over a long term, and it is possible to improve the charging stability of the toner at the time of long-term use and the color reproducibility in a color image.

As described above, according to the present invention, there is provided a means for reducing the difference in charge amount between the toners of the respective colors at the time of initial use and the long-term use and improving the color reproducibility of the color image at the time of long-term use.

The above mechanism is based on estimation, and the present invention is not limited to the above mechanism.

Embodiments for carrying out the present invention will be described in detail below. It should be noted that the present invention is not limited to only the following embodiments. In addition, in the present specification, "X to Y" indicating the range includes "X" and "Y" and means "X or more and Y or less". Unless otherwise specified, the measurement of operation and physical properties is carried out under the conditions of room temperature (20° C. to 25° C.)/relative humidity 40% RH to 50% RH. In the present specification, (meth)acryl is a generic name of acryl and methacryl.

Further, in the present specification, the toner base particles are particles containing at least a binder resin, a coloring agent, a release agent, and a layered silicate compound, and optionally containing other internal additives. When external additives are added to the toner base particles, they become toner particles, and the aggregate of toner particles becomes a toner.

In addition, the yellow toner, the magenta toner, the cyan toner, and the black toner are also collectively referred to as "YMCK toner".

[Color Toner]

The image forming method and the toner set for developing the electrostatic latent image according to the present invention use a color toner including a yellow toner, a magenta toner, a cyan toner, and a black toner, and the yellow toner, the magenta toner, the cyan toner, and the black toner each contain at least a binder resin, a coloring agent, a release agent, and a layered silicate compound. In addition, if necessary, for example, an internal additive such as a charge control agent or an external additive may be contained.

[Binder Resin]

Examples of the binder resin constituting the YMCK toner include vinyl resins such as a styrene resin, a (meth) acrylic resin, a styrene-(meth)acrylic copolymer resin, and an olefin resin, and various known resins such as a polyester resin, a polyamide resin, a polycarbonate resin, a polyether resin, a polyvinyl acetate resin, a polysulfone resin, an epoxy resin, a polyurethane resin, and a urea resin. These can be used solely or in combination of two or more kinds. In addition, as the binder resin, those modified with these resins can also be used. Further, as the binder resin, an amorphous resin or a crystalline resin may be used, or both of them may be used in combination.

In particular, it is preferable that the binder resin contains a vinyl resin, an unmodified polyester resin, and a modified polyester resin. Hereinafter, the vinyl resin, the unmodified polyester resin, and the modified polyester resin will be described.

(Vinyl Resin)

From the viewpoint of polymerizability (formation property of resin particles), the polymerizable monomer constituting the vinyl resin preferably contains the following vinyl monomers (1) to (9). These vinyl monomers may be used solely or in combination of two or more kinds.

(1) Styrene or Styrene Derivative

Styrene, o-methylstyrene, m-methylstyrene, p-methylstyrene, α-methylstyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene, p-n-dodecylstyrene, and the like.

(2) Methacrylic Acid Ester or Methacrylic Acid Ester Derivative

Methyl methacrylate, ethyl methacrylate, n-butyl methacrylate, isopropyl methacrylate, isobutyl methacrylate, t-butyl methacrylate, cyclohexyl methacrylate, n-octyl methacrylate, 2-ethylhexyl methacrylate, stearyl methacrylate, methacrylic acid lauryl, phenyl methacrylate, diethylaminoethyl methacrylate, dimethylaminoethyl methacrylate, 2-hydroxyethyl methacrylate, 2-hydroxypropyl methacrylate, 3-hydroxypropyl methacrylate, 2-hydroxybutyl methacrylate, 3-hydroxybutyl methacrylate, 4-hydroxybutyl methacrylate, polyethylene glycol monomethacrylate, and the like.

(3) Acrylic Acid Ester or Acrylic Acid Ester Derivative

Methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate, 2-hydroxyethyl acrylate, 2-hydroxypropyl acrylate, 3-hydroxypropyl acrylate, 2-hydroxybutyl acrylate, 3-hydroxybutyl acrylate, 4-hydroxybutyl acrylate, polyethylene glycol monoacrylate, and the like.

(4) Olefins

Ethylene, propylene, isobutylene, and the like.

(5) Vinyl Esters

Vinyl propionate, vinyl acetate, vinyl benzoate, and the like.

(6) Vinyl Ethers

Vinyl methyl ether, vinyl ethyl ether, and the like.

(7) Vinyl Ketones

Vinyl methyl ketone, vinyl ethyl ketone, vinyl hexyl ketone, and the like.

(8) N-vinyl Compounds

N-vinylcarbazole, N-vinylindole, N-vinylpyrrolidone, and the like.

(9) Monomer Having Carboxyl Group

Acrylic acid, methacrylic acid, maleic acid, itaconic acid, cinnamic acid, fumaric acid, maleic acid monoalkyl ester, itaconic acid monoalkyl ester, and the like.

(10) Others

Vinyl compounds such as vinyl naphthalene and vinyl pyridine; acrylic acid or methacrylic acid derivatives such as acrylonitrile and methacrylonitrile; a reactive surfactant having a vinyl bond such as a sodium salt of sulfuric ester of methacrylic acid ethylene oxide adduct, and the like.

Among the above vinyl monomers, from the viewpoint of stabilizing the polymerization reaction, (1) styrene or styrene derivatives, (2) methacrylic acid ester or methacrylic acid ester derivative, (3) acrylic acid ester or acrylic acid ester derivative, and (9) a monomer having a carboxyl group and a reactive surfactant having a vinyl bond are preferable. More preferably, there are styrene, methyl acrylate, ethyl acrylate, isopropyl acrylate, n-butyl acrylate, t-butyl acrylate, isobutyl acrylate, methyl methacrylate, ethyl methacrylate, isopropyl methacrylate, n-butyl methacrylate, methacrylic acid t-butyl, isobutyl methacrylate, acrylic acid, methacrylic acid, and sodium salt of sulfuric ester of methacrylic acid ethylene oxide adduct sulfuric acid ester.

The method for producing the vinyl resin is not particularly limited, and includes a method that uses an arbitrary polymerization initiator such as a peroxide, a persulfate, a persulfide, an azo compound, or the like, which is usually used for polymerization of the above monomer, and performs polymerization by a known polymerization technique such as a bulk polymerization method, a solution polymerization method, an emulsion polymerization method, a mini-emulsion method, a dispersion polymerization method, and the like. In addition, in order to adjust the molecular weight, generally used chain transfer agents can be used. The chain transfer agent is not particularly limited, and examples thereof include alkyl mercaptan and mercapto fatty acid ester.

The weight average molecular weight (Mw) of the vinyl resin is preferably from 10,000 to 500,000, and more preferably from 20,000 to 200,000.

In the present specification, the weight average molecular weight (Mw) of the resin is measured under the following conditions using gel permeation chromatography (GPC). That is, the sample to be measured is dissolved in tetrahydrofuran so as to have a concentration of 1 mg/mL. As the dissolution condition, an ultrasonic disperser is used at room temperature for 5 minutes. Next, after a process with a membrane filter having a pore size of 0.2 μm, 10 μL sample solution is injected into GPC. In the molecular weight measurement of the sample, the molecular weight distribution of the sample is calculated by using a calibration curve measured using monodisperse polystyrene standard particles. Ten points are used as polystyrene for calibration curve measurement.

The content of the vinyl resin is preferably 5% to 15% by mass with respect to the total mass of the toner base particles.

The glass transition temperature (Tg) of the vinyl resin is preferably from 0° C. to 100° C., and more preferably from 10° C. to 80° C.

In the present specification, the glass transition temperature of the vinyl resin can be measured by using a differential scanning calorimeter (DSC-60A, manufactured by Shimadzu Corporation) according to ASTM D 3418. The temperature correction of the detection part of this device (DSC-60A) uses the melting point of indium and the melting point of zinc, and the heat of melting of indium is used for correction of the calorific value. The sample uses an aluminum pan, set empty pan for control, increases the temperature at a heating rate of 10° C./min, holds at 200° C. for 5 minutes, lowers the temperature from 200° C. to 0° C. at −10° C./min using liquid nitrogen, holds at 0° C. for 5 minutes, increases the temperature again from 0° C. to 200° C. at 10° C./min, performs analysis from the endothermic curve at the second temperature rise, and sets onset temperature as Tg.

(Unmodified Polyester Resin)

The unmodified polyester resin usable in the present invention is usually obtained by polycondensation of a polyol and a polycarboxylic acid. As the polyol, a diol and a trivalent or higher polyol can be mentioned, and a diol alone or a mixture of a diol and a small amount of a trivalent or higher polyol is preferable. Examples of the diol include: alkylene glycol (ethylene glycol, 1,2-propylene glycol, 1,3-propylene glycol, 1,4-butanediol, 1,6-hexanediol, 1,8-octanediol, 1,10-decanediol, 1, 12-dodecanediol, and the like); polyalkylene ether glycol (diethylene glycol, triethylene glycol, dipropylene glycol, polyethylene glycol, polypropylene glycol, polytetramethylene ether glycol, and the like); alicyclic diols (cyclohexane diol, 1,4-cyclohexane dimethanol, hydrogenated bisphenol A, and the like); bisphenols (bisphenol A, bisphenol F, bisphenol S, and the like); an adduct of an alkylene oxide (ethylene oxide, propylene oxide, butylene oxide, and the like) of the alicyclic diol; the alkylene oxide (ethylene oxide, propylene oxide, butylene oxide, and the like) adducts of the bisphenols, and the like. Among these, alkylene glycols having 2 to 12 carbon atoms and alkylene oxide adducts of bisphenols are preferable, and alkylene oxide adducts of bisphenols are particularly preferred. Examples of the trivalent or higher polyol include: polyhydric aliphatic alcohols having 3 to 8 valences or more (glycerin, trimethylolethane, trimethylolpropane, pentaerythritol, sorbitol and the like); trivalent or more valent polyphenols (trisphenol PA, phenol novolac, cresol novolac, and the like); the alkylene oxide adduct of trivalent or higher valent polyphenols, and the like.

Examples of the polycarboxylic acid include a dicarboxylic acid and a trivalent or higher polycarboxylic acid, and a dicarboxylic acid alone or a mixture of a dicarboxylic acid and a small amount of a trivalent or higher polycarboxylic acid is preferable. Examples of the dicarboxylic acid include: alkylene dicarboxylic acids (succinic acid, adipic acid, sebacic acid, malonic acid, and the like); alkenylene dicarboxylic acid (maleic acid, fumaric acid, and the like); aromatic dicarboxylic acids (phthalic acid, isophthalic acid, terephthalic acid, naphthalene dicarboxylic acid, and the like), and the like. Examples of the trivalent or higher polycarboxylic acid include 1,2,4-benzenetricarboxylic acid (trimellitic acid), 1,2,5-benzenetricarboxylic acid, 1,2,4-cyclohexanetricarboxylic acid, 1,2,4-naphthalenetricarboxylic acid, 1,2,5-hexane tricarboxylic acid, 1,3-dicarboxyl-2-methylene carboxypropane, 1,2,7,8-octane tetracarboxylic acid, 1,2,4,5-benzene tetracarboxylic acid (pyromellitic acid), and the like. As the polycarboxylic acid, an acid anhydride or a lower alkyl ester (methyl ester, ethyl ester, isopropyl ester, and the like) of the above compound may be used.

These polyols and polycarboxylic acids can be used solely or in combination of two or more kinds.

A method for producing the unmodified polyester resin is not particularly limited, and for example, a method for polycondensing (esterifying) the polyol and the polycarboxylic acid by using a known esterification catalyst may be used, if necessary.

Examples of the catalyst usable in the production include: alkali metal compounds such as sodium and lithium; compounds containing a Group 2 element such as magnesium and calcium; metal compounds such as aluminum, zinc, manganese, antimony, titanium, tin, zirconium, germanium and the like; phosphite compound; phosphate compound; and amine compound. Considering availability and the like, dibutyltin oxide (dibutyltin oxide), tin ocrylate, tin dioctylate, salts thereof, tetra-n-butyl titanate (tetrabutyl orthotitanate, $Ti(O\text{-}n\text{-}Bu)_4$), tetraisopropyl titanate (titanium tetraisopropoxide), tetramethyl titanate, or the like is preferably used. These can be used solely or in combination of two or more kinds.

The temperature of polycondensation (esterification) is not particularly limited, but it is preferably 150° C. to 250° C. The time of polycondensation (esterification) is not particularly limited, but it is preferably 0.5 hours to 15 hours. During polycondensation, the interior of the reaction system may be depressurized if necessary.

The content of the unmodified polyester resin is preferably 50% to 75% by mass with respect to the total mass of the toner base particles.

(Modified Polyester Resin)

The modified polyester resin can be obtained by modifying the side chain or terminal functional group of the unmodified polyester resin with an isocyanate compound, an epoxy compound, an amine compound, or the like.

Specifically, there is an aliphatic, alicyclic or aromatic isocyanate compound; aliphatic, alicyclic or aromatic monoepoxy compounds, diepoxy compounds, or triepoxy compounds; an aliphatic, alicyclic or aromatic monoamine compound containing a primary amino group or a secondary amino group, a diamine compound, a triamine compound, or a tetraamine compound, or the like.

Among them, from the viewpoint of improving the dispersibility of the layered silicate compound in the toner, a urea-modified polyester resin obtained by modifying an unmodified polyester resin with an isocyanate compound and an amine compound is preferable.

The method for producing the urea-modified polyester resin used in the present invention is not particularly limited, but may include a method for adding a compound having an active hydrogen group in an organic solvent and a polymer having a site capable of reacting with the compound having an active hydrogen group and subjecting the compound having an active hydrogen group to the reaction with the polymer upon granulation in an aqueous medium. As a polymer having a site capable of reacting with a compound having an active hydrogen group, a polyester prepolymer having an isocyanate group is preferable, and an amine compound is preferable as a compound having an active hydrogen group.

The polyester prepolymer having an isocyanate group can be obtained by further reacting a polyester resin having an active hydrogen group with a polycondensate of a polyol and a polycarboxylic acid with an isocyanate compound. In this case, examples of the active hydrogen group possessed by the polyester resin include a hydroxy group (an alcoholic hydroxy group and a phenolic hydroxy group), an amino group, a carboxyl group, a mercapto group, and the like. Among them, alcoholic hydroxy group is more preferable.

Since examples of the polyol and the polycarboxylic acid and the method for polycondensing these are the same as those of the compound and the method explained for the unmodified polyester resin, the description thereof will be omitted herein.

Examples of the isocyanate compound include one or more of: aliphatic polyisocyanate (tetramethylene diisocyanate, hexamethylene diisocyanate, 2,6-diisocyanatomethyl caproate, and the like); alicyclic polyisocyanate (isophorone diisocyanate, cyclohexylmethane diisocyanate, and the like); aromatic diisocyanates (tolylene diisocyanate, diphenylmethane diisocyanate, and the like); aromatic aliphatic diisocyanates (such as α, α, α', α'-tetramethylxylylene diisocyanate); isocyanurates; those obtained by blocking the polyisocyanate with a phenol derivative, oxime, caprolactam or the like.

As the amine compound, a polyamine and/or an amine compound having an active hydrogen-containing group is used. The active hydrogen-containing group in this case includes a hydroxy group and a mercapto group. Examples of such an amine compound include diamine, trivalent or higher polyamine, amino alcohol, amino mercaptan, an amino acid, and a compound obtained by blocking the amino group of these compounds. Examples of the diamine include: aromatic diamines (such as phenylenediamine, diethyltoluenediamine, 4,4'-diaminodiphenylmethane, and the like); cycloaliphatic diamine (4,4'-diamino-3,3'-dimethyldicyclohexylmethane, diamine cyclohexane, isophorone diamine, and the like); and aliphatic diamines (ethylenediamine, tetramethylenediamine, hexamethylenediamine, and the like), and the like. Examples of polyamines having three or more valences include diethylene triamine and triethylene tetramine Examples of the aminoalcohol include ethanolamine, hydroxyethylaniline, and the like. Examples of amino mercaptan include aminoethyl mercaptan, aminopropyl mercaptan, and the like. Examples of amino acids include aminopropionic acid, aminocaproic acid, and the like. Compounds in which amino groups of these amine compounds are blocked can also be used. A specific example includes ketimine compounds and oxazoline compounds obtained from the amine compounds and ketone compounds (acetone, methyl ethyl ketone, methyl isobutyl ketone, and the like).

Among these amine compounds, compounds in which the amino group of the amine compound is blocked are preferable.

The content of the urea-modified polyester resin is preferably 1% to 85% by mass with respect to the total mass of the toner base particles.

(Weight Average Molecular Weight of Polyester Resin)

The weight average molecular weight (Mw) of the polyester resin (unmodified polyester resin, modified polyester resin) is not particularly limited, but is preferably in the range of 5,000 to 100,000, and more preferably in the range of 5,000 to 50,000.

[Layered Silicate Compound]

The YMCK toner according to the present invention contains a layered silicate compound. By adding the layered silicate compound, the toner can be made heterogeneous and the cleaning performance can be improved. In the preferable method for producing a toner described later, when the toner material liquid is emulsified in an aqueous medium in the presence of a surfactant and resin particles, it is considered that the layered silicate compound in the toner material liquid moves to the interface between the organic solvent and/or the monomer oil droplet and the aqueous medium and gathers in the vicinity of the surface of the emulsified dispersion (reactant). As a result, it is considered that the layered silicate compound tends to be present in the vicinity of the surface of the toner, the toner becomes heterogeneous, the releasability of the toner from the photosensitive member is improved, and the cleaning performance is improved.

In addition, the aluminum element contained in the layered silicate compound has a function of suppressing excessive charging of the toner, and thus, by setting the content of aluminum element to the relationship of the above Formulae (1) to (3), it is possible to reduce the difference in charge amount between toners of respective colors, and the charging stability improves. In addition, due to this, it is possible to stably maintain the developability and transferability of the toner of each color over a long term, and it is possible to improve the charging stability of the toner at the time of long-term use and the color reproducibility in a color image.

The layered silicate compound used in the present invention is a silicate compound containing an aluminum (Al) element and a silicon (Si) element, and is a compound in which layers having a thickness of 1 nm to several nm are superimposed. The layered silicate compound is not particularly limited and may be appropriately selected and used according to the purpose. Specific examples include smectite clay mineral (montmorillonite, saponite, hectorite, and the like), kaolin group clay mineral (kaolinite and the like), bentonite, attapulgite, magadiite, kanemite, and the like. These may be used solely or in combination of two or more kinds. Among them, montmorillonite, bentonite, hectorite, and attapulgite are preferable from the viewpoint of controlling unevenness, and montmorillonite is more preferable from the viewpoint of ease of imparting charging property to the toner.

The layered silicate compound used in the present invention may be a natural product, a synthesized product, a commercially available product, or a mixture thereof. A synthesis method of the layered silicate compound includes, for example, a hydrothermal synthesis reaction method, a solid phase reaction method, a melt synthesis method, and the like.

From the viewpoint of ease of incorporation into the toner, the layered silicate compound according to the present invention is preferably a layered silicate compound obtained by modifying at least a part of ions present between layers with organic ions (hereinafter also simply referred to as "organically modified layered silicate compound"). When the organically modified layered silicate compound is added, the phenomenon that the liquid containing the material constituting the toner becomes thixotropic, the viscosity is low during stirring, the particle size distribution becomes narrow and uniform, and when the stirring is stopped, the phenomenon that the viscosity increases can be seen. Therefore, it is considered that the spherical formation of the toner material due to the interfacial tension can be prevented and the shape during stirring can be maintained.

Here, modifying with organic ions means introducing organic ions as ions existing between the layers. This is called intercalation in a broad sense. As the organically modified layered silicate compound, those obtained by modifying the layered silicate compound with an organic cation are preferable.

Examples of the organic cation modifier of the organically modified layered silicate compound include a quaternary alkyl ammonium salt, a phosphonium salt, and an imidazolium salt, and a quaternary alkyl ammonium salt is preferable. Examples of the quaternary alkyl ammonium salt include a trimethyl stearyl ammonium salt, a dimethyl stearyl benzyl ammonium salt, a dimethyl dioctadecyl ammonium salt, an oleyl bis(2-hydroxyethyl) methyl ammonium salt, and the like.

Examples of commercial products of organically modified layered silicate compounds include: quaternium-18 bentonite such as Bentone (registered trademark) 3, Bentone (registered trademark) 38, Bentone (registered trademark) 38V (manufactured by Rheox Co., Ltd.), Tixogel VP (manufactured by United Catalysts), Clayton (registered trademark) 34, Clayton (registered trademark) 40, and Clayton (registered trademark) XL (manufactured by Southern Clay Products Co., Ltd.); stearalkonium bentonite such as Bentone (registered trademark) 27 (manufactured by Rheox), Tixogel LG (manufactured by United Catalysts), Clayton (registered trademark) AF, and Clayton (registered trademark) APA (manufactured by Southern Clay Products Co., Ltd.); and quaternium 18/benzalkonium bentonite such as Clayton (registered trademark) HT and Kraton (registered trademark) PS (manufactured by Southern Clay Products Co., Ltd.), GARAMITE (registered trademark) 1958, and LAPONITE (registered trademark) 1958 RD (manufactured by BYK Japan K.K.). In particular, Clayton (registered trademark) AF, Clayton (registered trademark) APA, and LAPONITE (registered trademark) 1958RD are preferable.

As described above, when the YMCK toner is produced by a preferable toner manufacturing method described later, the layered silicate compound tends to be present near the surface of the toner. Here, the vicinity of the surface of the toner means a range of a thickness within 1 μm from the surface of the toner. Whether the layered silicate compound exists in the vicinity of the surface of the toner can be confirmed by a photograph of a cross-section of the toner taken with a transmission electron microscope (TEM).

A specific confirmation method is as follows. First, the toner particles are thoroughly dispersed in a room temperature-curable epoxy resin, embedded, dispersed in styrene powder having a particle diameter of about 100 nm, and then pressure-molded. If necessary, the obtained block is dyed with ruthenium tetroxide and osmium tetroxide in combination, a flaky sample was cut out by using a microtome equipped with diamond teeth. When photographed at about 40,000 to about 150,000 times by using a transmission electron microscope (TEM), a cross-section of the layered silicate compound is observed.

<Content of Aluminum Element>

In the present invention, when Al (Y) (unit: kcps) is the content of aluminum element in the yellow toner expressed by Net intensity by wavelength dispersion type fluorescent X-ray analysis, Al (M) (unit: kcps) is the content of aluminum element in the magenta toner expressed by Net intensity by wavelength dispersion type fluorescent X-ray analysis, Al (C) (unit: kcps) is the content of aluminum element in the cyan toner expressed by Net intensity by wavelength dispersion type fluorescent X-ray analysis, and Al (K) (unit: kcps) is the content of aluminum element in the black toner expressed by Net intensity by wavelength dispersion type fluorescent X-ray analysis, the following Formulae (1) to (3) are satisfied.

[Math. 5]

$$\mathrm{Al}(Y)<\mathrm{Al}(M)<\mathrm{Al}(C) \quad (1)$$

$$\mathrm{Al}(Y)<\mathrm{Al}(K)<\mathrm{Al}(C) \quad (2)$$

$$3.18<[\mathrm{Al}(C)-\mathrm{Al}(Y)]<8.65 \quad (3)$$

When at least one of the above Formulae (1), (2), and (3) is not satisfied, the difference in charge amount between the Y, M, C, and K toners at the time of initial use and the long-term use becomes large, and the color reproducibility of the color image at the time of long-term use is deteriorated.

[Al (C)−Al (Y)] of the above Formula (3) is preferably 3.40 to 7.87, more preferably 4.13 to 7.08, and still more preferably 4.92 to 6.29.

The content of aluminum element in the YMCK toner can be measured by using a fluorescent X-ray analyzer "XRF-1700" (manufactured by Shimadzu Corporation). Specifically, 2 g of the sample is pressurized to form pellets, and the measurement is carried out under the following conditions by qualitative quantitative analysis. For the measurement, the Kα peak angle of the element to be measured is determined and used from the 20 table:

X-ray generator condition/target Rh, tube voltage 40 kV, tube current 95 mA, no filter Spectroscopic condition/slit standard, without attenuator, spectroscopic crystal (Al=PET), detector (Al=FPC).

The content of the aluminum element in the YMCK toner can be controlled by adjusting the amount of the layered silicate compound to be added.

The addition amount of the layered silicate compound in the YMCK toner is not particularly limited. However, in one example, the content of the layered silicate compound in the yellow toner is preferably from 0.01% to 3.0% by mass, and more preferably from 0.1% to 2.0% by mass. The content of the layered silicate compound in the magenta toner is preferably from 0.01% to 4.0% by mass, and more preferably from 0.5% to 2.5% by mass. The content of the layered inorganic compound in the cyan toner is preferably 0.1% to 7.0% by mass, and more preferably 1.5% to 4.5% by mass.

The content of the layered silicate compound in the black toner is preferably from 0.01% to 6.0% by mass, and more preferably from 0.5% to 3.5% by mass.

Preferably, Al (Y), Al (M), Al (C), and Al (K) satisfy the following Formulae (4) to (10). By satisfying the following Formulae (4) to (10), the average value of the charge amount of the YMCK toner is in a preferable range (preferably 25 μC/g to 55 μC/g), and the transferability and developability of the toner become favorable.

[Math. 6]

$$0.49<\mathrm{Al}(Y)<3.85 \quad (4)$$

$$2.41<\mathrm{Al}(M)<4.91 \quad (5)$$

$$5.41<\mathrm{Al}(C)<10.14 \quad (6)$$

$$2.27<\mathrm{Al}(K)<7.94 \quad (7)$$

$$0.1001<[\mathrm{Al}(Y)/\mathrm{Al}(M)]<1 \quad (8)$$

$$0.0484<[\mathrm{Al}(Y)/\mathrm{Al}(C)]<0.7105 \quad (9)$$

$$0.0618<[\mathrm{Al}(Y)/\mathrm{Al}(K)]<1 \quad (10)$$

More preferably, Al (Y), Al (M), Al (C), and Al (K) satisfy the following Formulae (11) to (15). When the following Formulae (11) to (15) are satisfied, the difference in charge amount between the Y, M, C, and K toners at the time of initial use and the long-term use is further reduced, and the color reproducibility of the color image at the time of long-term use is further improved.

[Math. 7]

$$0.1513<[\mathrm{Al}(Y)/\mathrm{Al}(M)]<0.9436 \quad (11)$$

$$0.0703<[\mathrm{Al}(Y)/\mathrm{Al}(C)]<0.4494 \quad (12)$$

$$0.1179<[\mathrm{Al}(Y)/\mathrm{Al}(K)]<1 \quad (13)$$

$$2.040<[\mathrm{Al}(C)/\mathrm{Al}(M)]<2.390 \quad (14)$$

$$0.375<[\mathrm{Al}(K)/\mathrm{Al}(M)]<1.712 \quad (15)$$

Preferably, Al (Y), Al (M), Al (C), and Al (K) satisfy the following Formulae (16) to (20). When the following Formulae (16) to (20) are satisfied, the difference in charge amount between the Y, M, C, and K toners at the time of initial use and the long-term use is further reduced, and the color reproducibility of the color image at the time of long-term use is further improved.

[Math. 8]

$$0.1735<[\mathrm{Al}(Y)/\mathrm{Al}(M)]<0.8563 \quad (16)$$

$$0.0792<[\mathrm{Al}(Y)/\mathrm{Al}(C)]<0.4116 \quad (17)$$

$$0.1524<[\mathrm{Al}(Y)/\mathrm{Al}(K)]<0.5500 \quad (18)$$

$$2.051<[\mathrm{Al}(C)/\mathrm{Al}(M)]<2.314 \quad (19)$$

$$0.667<[\mathrm{Al}(K)/\mathrm{Al}(M)]<1.669 \quad (20)$$

In particular, preferably, Al (Y), Al (M), Al (C), and Al (K) satisfy the following Formulae (21) to (25). When the following Formulae (21) to (25) are satisfied, the difference in charge amount between the Y, M, C, and K toners at the time of initial use and the long-term use is further reduced, and the color reproducibility of the color image at the time of long-term use is further improved.

[Math. 9]

$$0.2033<[\mathrm{Al}(Y)/\mathrm{Al}(M)]<0.7839 \quad (21)$$

$$0.0900<[\mathrm{Al}(Y)/\mathrm{Al}(C)]<0.3796 \quad (22)$$

$$0.2155<[\mathrm{Al}(Y)/\mathrm{Al}(K)]<0.4847 \quad (23)$$

$$2.064<[\mathrm{Al}(C)/\mathrm{Al}(M)]<2.242 \quad (24)$$

$$0.943<[\mathrm{Al}(K)/\mathrm{Al}(M)]<1.618 \quad (25)$$

In addition, preferably, Al (C) and Al (K) satisfy the following Formula (26). When the following Formula (26) is satisfied, the difference in charge amount between the cyan toner and the black toner at the time of initial use and long-term use is further reduced, and the color reproducibility of the color image at the time of long-term use is further improved.

[Math. 10]

$$1.72<[\mathrm{Al}(C)-\mathrm{Al}(K)]<3.41 \quad (26)$$

[Coloring Agent]

As the coloring agent used in the YMCK toner according to the present invention, various organic or inorganic pigments of each color as exemplified below can be used, and if necessary, two or more coloring agents may be used in combination.

Specifically, as the coloring agent for the black toner, a carbon black, a magnetic material, an iron-titanium composite oxide black, or the like can be used. Examples of the carbon black include a channel black, a furnace black, an acetylene black, a thermal black, a lamp black, and the like, and Examples of the magnetic material include ferrite and magnetite.

Examples of the coloring agent for the yellow toner, as a dye, include C.I. Solvent Yellow 2, 6, 14, 15, 16, 19, 21, 33, 44, 56, 61, 77, 79, 80, 81, 82 93, 98, 103, 104, 112, 162, or the like, and as a pigment, include C.I Pigment Yellow 1, 3, 5, 11, 12, 13, 14, 15, 17, 62, 65, 73, 74, 81, 83, 93, 94, 97, 138, 139, 147, 150, 151, 154, 155, 162, 168, 174, 176, 180, 183, 185, 191, or the like. Mixtures of these can also be used.

Examples of the coloring agent for the magenta toner, as a dye, include C.I. Pigment Red 1, 49, 52, 58, 63, 111, 122, or the like, and as a pigment, include C. I. Pigment Red 2, 3, 4, 5, 6, 7, 8, 13, 15, 16, 21, 22, 23, 31, 48: 1, 48: 2, 48: 3, 48: 4, 49: 1, 53: 1, 57: 1, 60, 63, 63: 1, 64, 68, 81, 83, 87, 88, 89, 90, 112, 114, 122, 123, 139, 144, 146, 149, 150, 163, 166, 169, 170, 175, 176, 177, 178, 184, 185, 188, 202, 206, 207, 208, 209, 210, 222, 238, 254, 255, 266, 268, 269, or the like. Mixtures of these can also be used.

Examples of the coloring agent for the cyan toner, as a dye, include C.I. Solvent Blue 25, 36, 60, 70, 93, 95, or the like, and as a pigment, include C.I. Pigment Blue 2, 3, 15, 15: 2, 15: 3, 15: 4, 16, 17, 60, 62, 66, or the like. Mixtures of these can also be used.

The content of the coloring agent in the toner is preferably from 1% to 30% by mass, and more preferably from 2% to 20% by mass. The number average primary particle diameter of the coloring agent is not particularly limited, but is preferably about 10 nm to 200 nm.

As the coloring agent, a surface-modified one can also be used. As the surface modifying agent, conventionally known ones can be used, and specifically, a silane coupling agent, a titanium coupling agent, an aluminum coupling agent, and the like can be used.

[Release Agent]

The YMCK toner according to the present invention contains a release agent. The release agent is not particularly limited, and various known waxes are used. Specifically, examples of the release agent include polyolefin wax such as polyethylene wax and polypropylene wax, branched chain hydrocarbon wax such as microcrystalline wax, long chain hydrocarbon waxes such as paraffin wax and sazol wax, dialkyl ketone type wax such as distearyl ketone, Ester type wax such as carnauba wax, montan wax, behenyl behenate, trimethylol propane tribehenate, pentaerythritol tetrabehenate, pentaerythritol diacetate dibehenate, glycerin tribehenate, 1,18-octadecanediol distearate, Tristearyl trimellitate, or distearyl maleate, and amide type wax such as ethylenediamine behenylamide or trimellitic acid tristearylamide.

The content of the release agent in the toner is preferably from 0.1% to 30% by mass, and more preferably from 1% to 15% by mass. When the addition amount of the release agent is 0.1% by mass or more, it is preferable from the viewpoint of suppression of image defects due to peeling failure between the fixing member and the image. In addition, when the addition amount of the release agent is 30% by mass or less, it is preferable since good image quality can be obtained.

[Charge Control Agent]

The color toner according to the present invention may contain a charge control agent. As the charge control agent, various well-known compounds that can be dispersed in an aqueous medium can be used. Specifically, examples of the charge control agent include nigrosine-based dyes, metal salt of naphthenic acid or higher fatty acid, alkoxylated amines, quaternary ammonium salt compounds, azo type metal complex, salicylic acid metal salt, or the metal complex.

The content of the charge control agent in the toner is preferably from 0% to 10% by mass, and more preferably from 0% to 5% by mass.

[External Additive]

The surface of the toner base particles according to the present invention may contain an external additive for the purpose of controlling fluidity and chargeability.

As the external additive, conventionally known metal oxide particles can be used. Examples of the external additive include silica particles, titanium oxide particles, alumina particles, zirconia particles, zinc oxide particles, chromium oxide particles, cerium oxide particles, antimony oxide particles, tungsten oxide particles, tin oxide particles, tellurium oxide particles, manganese oxide particles, and boron oxide particles. These may be used solely or in combination of two or more kinds.

In addition, organic particles such as homopolymers of styrene, methyl methacrylate, and the like and copolymers thereof may also be used as the external additive.

The metal oxide particles used as the external additive are preferably those which have undergone surface hydrophobic treatment with a known surface treatment agent such as a coupling agent. Examples of the surface treatment agent include dimethyldimethoxysilane, hexamethyldisilazane (HMDS), methyltrimethoxysilane, isobutyltrimethoxysilane, decyltrimethoxysilane, silicone oil, and the like.

In order to further improve the cleaning performance and transferability, it is also possible to use a lubricant or an abrasive as the external additive. Examples of the lubricant include metal salts of higher fatty acids, such as salts of zinc, aluminum, copper, magnesium, calcium, and the like of stearic acid, salts of zinc, manganese, iron, copper, magnesium, and the like of oleic acid, salts of zinc, copper, magnesium, calcium and the like of palmitic acid, salts of zinc, calcium, and the like of linoleic acid, salts of zinc, calcium, and the like of ricinoleic acid.

Examples of the polishing agent include strontium titanate, cerium oxide, barium titanate, calcium carbonate, alumina, and the like.

The total addition amount of these external additives is preferably from 0.1 to 10 parts by mass, more preferably from 1 to 5 parts by mass, based on 100 parts by mass of the toner base particles.

The YMCK toner according to the present invention may have a so-called single layer structure or may have a core-shell structure (a mode in which the resin forming the shell layer is coagulated and fused on the surface of the core particle). The core-shell structure is not limited to a structure in which the shell layer completely covers the core particle, and includes, for example, those in which the core particle is exposed in some places.

The above-described toner form (cross-sectional structure of the core-shell structure and the like) can be confirmed by using a known means such as, for example, a transmission electron microscope (TEM) or a scanning probe microscope (SPM).

[Average Circularity]

The average circularity of the YMCK toner particles according to the present invention is preferably 0.920 to 0.980. Within this range, a toner having good developability and cleanability is obtained.

The average circularity can be measured by using, for example, a flow type particle image analyzer "FPIA-3000" (manufactured by Sysmex Corporation). Specifically, it can be measured by the following method. The toner particles are wetted with an aqueous surfactant solution, ultrasonic dispersion is performed for 1 minute to disperse the toner particles. After that, "FPIA-3000" is used, the measurement is made at an appropriate concentration of 3,000 to 10,000 HPF detections in the measurement condition HPF (high magnification imaging), and the circularity of each particle is calculated by the following formula. The calculated circularity of each particle is added up and the value obtained by division by the measured total number is the average circularity:

Circularity=(Perimeter of circle having the same projected area as particle image)/(Perimeter of particle projected image).

[Particle Diameter of Toner]

The toner (YMCK toner) according to the present invention has a volume average particle diameter of 4 μm to 6 μm. When the volume average particle diameter is less than 4 μm, the cleaning performance of the toner is deteriorated, the carrier is spent, and the charging stability at the time of long-term use decreases. On the other hand, when exceeding 6 μm, the toner scattering is liable to occur. The volume average particle diameter is preferably 4.5 μm to 5.5 μm.

The volume average particle diameter can be controlled by adjusting stirring speed, agitation time, type and addition amount of dispersing agent, or the like, when preparing a toner material liquid used in toner manufacture.

The volume average particle diameter of the toner can be measured and calculated by using a device connected to a computer system (manufactured by Beckman Coulter, Inc.) equipped with a data processing software "Software V 3.51" on a Coulter Counter Multisizer 3 (manufactured by Beckman Coulter, Inc.).

As a measurement procedure, first, 0.02 g of the toner is made to be compatible with 20 ml of the surfactant solution (For the purpose of improving the dispersibility of the toner, the surfactant solution is, for example, a neutral detergent containing a surfactant component diluted with pure water). After that, ultrasonic dispersion is performed for 1 minute to prepare a toner dispersion liquid. This toner dispersion liquid is injected into a beaker containing ISOTON II (manufactured by Beckman Coulter, Inc.) in a sample stand with a pipette until a measuring instrument display concentration becomes 5% to 10%. With this concentration range, reproducible measured values are obtained. In the measurement instrument, the number of measurement particles counted is set at 25,000, the aperture diameter is set to 100 μm, the frequency range is calculated by dividing the measurement range of 2.0 μm to 60 μm into 256, and the particle diameter of 50% is defined as the volume-based median diameter (volume D 50% diameter) from the side having the larger volume integral fraction.

[Method for Producing Toner]

The color toner (YMCK toner) according to the present invention can be produced by the following procedure. However, the following merely shows one example of the manufacturing method, and the method for manufacturing the color toner according to the present invention is not limited to the following manufacturing method.

(1) Binder Resin Production Step

When a vinyl resin is used as one component of the binder resin, the vinyl resin is produced. Since the method for producing the vinyl resin has been described above, the description thereof is omitted herein. When the vinyl resin is produced by emulsion polymerization, the obtained aqueous dispersion liquid of vinyl resin particles can be used as it is in the subsequent steps.

The volume-based median diameter of the vinyl resin particles in the aqueous dispersion liquid is preferably in the range of 60 nm to 1,000 nm, and more preferably in the range of 80 nm to 500 nm. The volume-based median diameter can be controlled by the magnitude of mechanical energy during polymerization or the like.

When an unmodified polyester resin is used as one component of the binder resin, the unmodified polyester resin is produced. Since the method for producing the unmodified polyester resin has been described above, the description thereof will be omitted herein.

When a urea-modified polyester resin is used as one component of the binder resin, first, a prepolymer of the urea-modified polyester resin is produced. Specifically, in the presence of a known esterification catalyst such as dibutyltin oxide, tetranormalbutyl titanate, tetraisopropyl titanate, tetramethyl titanate, or tetrastearyl titanate, the polyol and the polycarboxylic acid are preferably heated to 150° C. to 280° C., and if necessary, the produced water is distilled off under reduced pressure to polycondensate the dicarboxylic acid component and the diol component (esterification), thereby producing a polyester resin having a hydroxy group. Next, the polyisocyanate compound is reacted at a temperature of preferably 40° C. to 140° C. to obtain a polyester prepolymer having an isocyanate group. Furthermore, in the (4) polyester prepolymer reaction step described later, an amine compound is reacted with the polyester prepolymer to prepare a urea-modified polyester resin.

(2) Toner Material Liquid Preparation Step

This step is a step of preparing a toner material liquid by dispersing a toner constituent material such as a binder resin, a coloring agent, a release agent, and a layered silicate compound in an organic solvent.

As the organic solvent used for preparing the toner material liquid, a solvent having a boiling point lower than 100° C. and having volatility is preferable from the viewpoint of easy removal after the formation of toner base particles. Methyl acetate, ethyl acetate, methyl ethyl ketone, methyl isobutyl ketone, toluene, xylene, and the like can be used solely or in combination of two or more kinds.

The method for preparing the toner material liquid in this step may be a method of dispersing all of the toner constituent materials simultaneously in the toner material liquid, a method of dispersing them in several times, or a method of adding a layered silicate compound in the toner material liquid emulsification step (3) described later. The method is not particularly limited as long as it is possible to disperse toner constituent materials in the toner material liquid substantially uniformly.

In the case of adding the coloring agent, it may be added after it is compounded with a resin to form a master batch. The resin is not particularly limited, and can be appropriately selected from known ones according to the purpose. Examples of the resin include a (co)polymer of styrene or its substitution product, a polymethyl methacrylate resin, a polybutyl methacrylate resin, a polyvinyl chloride resin, a polyvinyl acetate resin, a polyethylene resin, a polypropylene resin, a polyester resin, an epoxy resin, an epoxy polyol resin, a polyurethane resin, a polyamide resin, a polyvinyl butyral resin, a polyacrylic acid resin, a rosin, modified rosin, a terpene resin, an aliphatic hydrocarbon resin, an alicyclic hydrocarbon resin, an aromatic petroleum resin, a chlorinated paraffin, and a paraffin. These may be used solely or in combination of two or more kinds.

(3) Toner Material Liquid Emulsification Step

This step is a step of preparing an emulsion by adding and dispersing the aforementioned toner material liquid into the aqueous medium.

Besides water alone, water-based media that can be used for emulsifying and dispersing the toner material liquid include alcohols (methanol, isopropyl alcohol, ethylene glycol, and the like), dimethylformamide, tetrahydrofuran, cellosolves (methyl cellosolve and the like), lower ketones (acetone, methyl ethyl ketone, and the like), and the like.

In order to improve the dispersibility of the toner material liquid, it is also possible to add a dispersant such as a surfactant or a resin particle in the aqueous medium.

A method of dispersion is not particularly limited, but a known dispersing machine such as a low-speed shearing type, a high-speed shearing type, a friction type, a high pressure jet type, an ultrasonic type, or a homomixer can be applied. Among them, a high-speed shearing disperser is preferable so as to make the size of the particles contained in the dispersion within a preferable range. In the case of using the high-speed shearing disperser, the rotational speed is not particularly limited, but is preferably from 1,000 to 30,000 rpm, and more preferably from 5,000 to 20,000 rpm. The dispersing time is not particularly limited, but in the case of the batch system, the dispersing time is usually from 0.1 minutes to 30 minutes. The temperature at the time of dispersion is usually 0° C. to 150° C. (under pressure).

(4) Polyester Prepolymer Reaction Step

This step is a step of adding an amine compound to the emulsion prepared in the toner material liquid emulsification step, reacting with a polyester prepolymer having an isocyanate group in a toner material liquid, preparing a urea-modified polyester resin which is one component of the binder resin, and forming a toner base particle dispersion liquid.

Although this step is described separately from the above-described toner material liquid emulsification step, an amine compound is added to carry out a reaction with a polyester prepolymer having an isocyanate group at the same time as the emulsification and dispersion in the toner material liquid emulsification step.

This reaction involves crosslinking or elongating the molecular chain of the polyester resin. The reaction time can be set based on the reactivity between the isocyanate structure of the polyester prepolymer and the amine compound. Specifically, the reaction time may be set to 10 minutes to 40 hours, and more preferably 2 to 24 hours. In addition, the reaction temperature is preferably from 0° C. to 150° C., and more preferably from 30° C. to 98° C. In addition, if necessary, a catalyst such as dibutyltin dilaurate, dioctyltin dilaurate, or the like can be used.

(5) Cleaning Step

This step is a step of cooling the toner base particle dispersion liquid obtained as described above, cooling and then solidifying and separating the toner base particles from the toner base particle dispersion liquid to remove the surfactant or the like from the toner base particles. That is, in this step, the toner base particles are solid-liquid separated from the toner base particle dispersion liquid having undergone the heterozygous treatment to form a toner cake (aggregated toner base particles in a cake state in a wet state), and deposits such as surfactants are removed from the obtained toner cake. Specific solid-liquid separation and washing methods include a centrifugal separation method, a reduced pressure filtration method using Nutsche, or the like, a filtration method using a filter press, and the like, and these are not particularly limited.

(6) Drying Step

This step is a step of performing drying treatment on the toner base particles which have been cleaned in the cleaning step. Examples of a dryer usable in the drying step include a spray dryer, a vacuum freeze dryer, a reduced pressure dryer, a stationary rack dryer, a mobile shelf dryer, a hot air dryer, a fluidized bed dryer, a rotary dryer, a stirring type dryer, a circulating dryer, and the like, and these are not particularly limited. The water content of the dried toner base particles is preferably 5% by mass or less, and more preferably 1% by mass or less.

(7) External Additive Addition Step

The external additive addition step is a step of adding a charge control agent and various external additives such as inorganic particles, organic particles, lubricant, and the like to the dried toner base particles for the purpose of improving fluidity and charging property and improving cleaning property, and is performed as necessary. Example of a device used for adding an external additive include various known mixing devices such as a turbulent mixer, a Henschel mixer (registered trademark), a Nauta mixer (registered trademark), a V type mixer, and a sample mill. In addition, in order to make the particle size distribution of the toner within an appropriate range, sieve classification may be performed as necessary.

[Developer]

The color toner (YMCK toner) according to the present invention can be used as a magnetic or nonmagnetic one-component developer, but it may be mixed with a carrier and used as a two-component developer.

As the carrier used in the present invention, magnetic particles made of conventionally known materials such as metals such as iron, ferrite, magnetite and alloys of these metals with metals such as aluminum and lead can be used, and in particular, ferrite is preferable.

Ferrite is a compound represented by formula: $(MO)_x(Fe_2O_3)_y$, and the molar ratio y of $Fe_2O_3$ constituting ferrite is preferably 30 mol % to 95 mol %. Within such a range, there is an advantage that a desired magnetization can be easily obtained, and a carrier which is difficult to cause carrier adhesion can be produced. M in the formula can be selected from manganese (Mn), magnesium (Mg), strontium (Sr), calcium (Ca), titanium (Ti), copper (Cu), zinc (Zn), nickel (Ni), aluminum (Al), silicon (Si), zirconium (Zr), bismuth (Bi), cobalt (Co), lithium (Li), and the like. These can be used solely or in combination of two or more kinds. Among them, from the viewpoint that the residual magnetization is low and preferable magnetic characteristics can be obtained, manganese, magnesium, strontium, lithium, copper, and zinc are preferable, and manganese, magnesium, and strontium are more preferable.

In addition, a coated carrier obtained by coating the surface of magnetic particles (core material particles) with a coating layer such as a resin, a binder type carrier (resin dispersion type carrier) in which a magnetic powder is dispersed in a binder resin, or the like may be used.

The coating resin constituting the coated carrier is not particularly limited, but examples thereof include an olefin resin, a styrene resin, a styrene-acrylic resin, an acrylic resin, a silicone resin, a polyester resin, a fluororesin, and the like. The coating resin preferably includes a resin having a constitutional unit derived from a (meth)acrylate monomer such as an alicyclic(meth)acrylate monomer.

In the coating layer of the coated carrier, in addition to the above-described coating resin, charge control particles, conductive particles, or the like may be contained as necessary. Examples of the charge control particles include strontium titanate, calcium titanate, magnesium oxide, azine compounds, quaternary ammonium salts, triphenylmethane, and the like. Examples of the conductive particles include carbon black, zinc oxide, tin oxide, and the like.

The binder resin constituting the binder type carrier (resin dispersion type carrier) is not particularly limited and known binder resins can be used. Examples of the binder resin include a styrene-acrylic resin, a polyester resin, a fluororesin, a phenol resin, and the like.

In the case of using the coated carrier, the volume-based median diameter of the core material particles is preferably 15 μm to 100 μm, and more preferably 25 μm to 80 μm. The volume-based median diameter of the carrier can typically be measured with a laser diffraction type particle size distribution measuring apparatus "HELOS" (manufactured by SYMPATEC) equipped with a wet type dispersing machine.

The shape factor (SF-1) of the core material particles is preferably 110 to 140, and more preferably 120 to 130. Within such a range, the coating layer can have a thickness distribution. In the portion where the coating layer is thin, since the volume resistivity of the carrier is lowered by the core material particles having the low resistance property, electrons easily move, and excessive charging under low temperature and low humidity is suppressed. In addition, since the charges can be retained in a thick portion of the coating layer, a reduction in the charge amount under high temperature and high humidity is suppressed. In other words, if within the above range, a carrier having a small environmental difference in charge amount can be obtained. Such a carrier can impart a constant charge amount to the toner even if the temperature and humidity environment changes.

The shape factor (SF-1) of the core material particle is a numerical value calculated by the following Formula (A).

[Math. 11]

$$\text{Shape Factor(SF-1)}=\{(\text{MXLNG})^2/(\text{AREA})\}\times(\pi/4)\times 100 \quad \text{(A)}$$

In the above formula, "MXLNG" represents the maximum diameter of the core material particle, and "AREA" represents the projected area of the core material particle. Here, the maximum diameter refers to the width at which the distance between the parallel lines becomes the maximum when a projected image of the core material particles on the plane is sandwiched by two parallel lines. The projected area is the area of the projected image of the core particle on the plane. The maximum diameter and the projected area of the core particles can be obtained by the following measuring method.

That is, at least 100 core particles selected randomly are photographed at 150 times with a scanning electron microscope, and the captured image is acquired by a scanner and measured by using an image processing analyzer LUZEX AP (manufactured by Nireco Corporation). The shape factor of the core material particle is a value calculated as the average value of the shape factor of each core material particle calculated by the above Formula (A).

The saturation magnetization of the core material particles is preferably $2.5\times10^{-5}$ Wb·m/kg to $1.0\times10^{-4}$ Wb·m/kg. Due to the use of the carrier having such magnetic properties, partial aggregation of carriers hardly occurs. Therefore, the two-component developer is uniformly dispersed on the surface of the developer conveying member, there is no unevenness in density, and a uniform and high-precision toner image can be formed. Residual magnetization can be reduced by using ferrite. If the residual magnetization is small, the fluidity of the carrier itself is good, and a two-component developer having a uniform bulk density can be obtained.

The two-component developer can be prepared by mixing the carrier and the toner using a mixing device. Examples of the mixing device include Henschel mixer (registered trademark), Nauta mixer (registered trademark), V type mixer, and the like. When preparing the two-component developer, the compounding amount of the toner is preferably 1 part by mass to 10 parts by mass based on 100 parts by mass of the carrier.

[Image Forming Method]

The image forming method according to the present embodiment includes a toner image forming step of forming a toner image by developing the color toner on an electrostatic latent image formed by charging and exposing a surface of an electrostatic latent image bearing member, a transfer step of transferring the toner image onto a recording medium to form a color toner image, and a fixing step of fixing the color toner image on the recording medium.

Examples of the image forming apparatus used in the image forming method of the present invention include a four-cycle type image forming apparatus constituted by four kinds of color developing devices related to each of yellow, magenta, cyan, and black and one electrostatic latent image bearing member (also referred to as "electrophotographic photosensitive member" or simply "photosensitive member"), a tandem type image forming apparatus in which an image forming unit having a color developing device of each color and an image forming unit having an electrostatic latent image bearing member are mounted for each color, and the like.

An example of the image forming method of the present invention will be described in more detail. The surface of the electrostatic latent image bearing member is uniformly charged (charging step) with a charging device such as a scorotron charger or a charging roller, scanning is performed in parallel with the rotation axis of the electrostatic latent image bearing member by a polygon mirror or the like, and an electrostatic latent image is formed by imagewise exposing the surface of the latent electrostatic image bearing member based on image data (exposure step). After that, in the developing apparatus filled with a one-component developer composed of toner or a two-component developer composed of toner and carrier, the toner is frictionally charged with a carrier in a stirring member, a developing roller, a regulating blade, or a two-component developer, and the toner held on the rotating developing roller or on the carrier on the developing sleeve is electrostatically conveyed (developed) onto the electrostatic latent image to visualize the same to obtain a toner image (toner image forming step). Then, this toner image is electrostatically and sequentially transferred onto a transfer medium such as a transfer belt to be transported, or a recording medium such as a paper sheet or a film by electrostatic transfer, and toner images of respective colors are superimposed, whereby a color toner image is formed (transfer step). After that, a color toner image transferred onto a recording medium or a color toner image secondarily transferred from a transfer medium onto a recording medium by secondary transfer means is heated and/or pressurized by a fixing process such as a contact heating method/a non-contact heating method, and the color toner image is fixed on the recording medium (fixing step), thereby obtaining a full color image.

[Recoding Medium]

The recording medium used in the image forming method of the present invention is not particularly limited. For example, various types of printing papers such as a plain paper from a thin paper to a thick paper, a high quality paper, a coated printing paper such as an art paper or a coated paper, a commercially available Japanese paper or a postcard paper, a synthetic paper, a film, a cloth, and the like can be used. Among these, the synthetic paper and film are preferred.

Here, Specific examples of the synthetic paper include a polypropylene synthetic paper. Specific examples of the film include a polyethylene terephthalate film (PET film), a polyethylene naphthalate film, a polyimide film, and the like.

EXAMPLES

The effects of the present invention will be described by using the following examples and comparative examples, but the present invention is not limited to these embodiments. In the examples, "part" or "%" is used, but unless otherwise specified, it means "part by mass" or "% by mass". In addition, unless otherwise specified, each operation was performed at room temperature (20° C. to 25° C.)/relative humidity 40% RH to 50% RH.

<Method for Measuring Various Physical Properties>

[Measurement of Glass Transition Temperature (Tg) of Resin]

The glass transition temperature of the resin was measured by using a differential scanning calorimeter (DSC-60A, manufactured by Shimadzu Corporation) according to ASTM D 3418. The temperature correction of the detection part of this device (DSC-60A) used the melting point of indium and the melting point of zinc, and the heat of melting of indium was used for correction of the calorific value. The sample used aluminum pan and empty pan was set for control. The sample increased the temperature at a heating rate of 10° C./min, was held at 200° C. for 5 minutes, lowered the temperature from 200° C. to 0° C. at −10° C./min using liquid nitrogen, was held at 0° C. for 5 minutes, increased the temperature again from 0° C. to 200° C. at 10° C./min, analysis was performed from the endothermic curve at the second temperature rise, and onset temperature was set as Tg.

[Measurement of Weight Average Molecular Weight (Mw) of Resin]

The weight average molecular weight (Mw) of the resin was measured by gel permeation chromatography (GPC) as follows.

The sample (resin) was added to tetrahydrofuran (THF) to a concentration of 1 mg/mL, dispersed for 5 minutes using an ultrasonic disperser at room temperature, and treated with a membrane filter with a pore size of 0.2 μm, thereby preparing a sample solution. Using a GPC apparatus HLC-8120 GPC (manufactured by Tosoh Corporation) and a column TSKguardcolumn+TSKgelSuperHZ-m3 (manufactured by Tosoh Corporation), tetrahydrofuran was flowed as a carrier solvent at a flow rate of 0.2 mL/min while maintaining the column temperature at 40° C. 10 μL of the prepared sample solution was injected into the GPC apparatus together with the carrier solvent, the sample is detected by using a refractive index detector (RI detector), and the molecular weight distribution of the sample was measured by using a calibration curve measured with monodispersed polystyrene standard particles, and the weight average molecular weight of the resin was determined. 10 points were used as polystyrene for calibration curve measurement.

Preparation of Black Toner 1

(Synthesis of Vinyl Resin Particle Dispersion Liquid)

In a reaction vessel equipped with a stirrer and a thermometer, 683 parts by mass of water, 11 parts by mass of sodium salt of sulfuric acid ester of methacrylic acid ethylene oxide adduct (Eleminol (registered trademark) RS-30 manufactured by Sanyo Chemical Industries, Ltd.), 83 parts by mass of styrene, 83 parts by mass of methacrylic acid, 110 parts by mass of n-butyl acrylate, and 1 part by mass of ammonium persulfate as a polymerization initiator were charged, and stirred at 3,800 rpm for 30 minutes, thereby obtaining a white emulsion. The temperature in the system was raised to 75° C. by heating, and reacted for 4 hours. Further, 30 parts by mass of a 1% ammonium persulfate aqueous solution was added and matured at 75° C. for 6 hours, thereby obtaining [vinyl resin particle dispersion liquid 1] which is an aqueous dispersion liquid of a vinyl resin (copolymer of ((styrene)-(methacrylic acid)-(n-butyl acrylate)-(sodium salt of sulfuric ester of methacrylic acid ethylene oxide adduct)). With respect to the vinyl resin particles in [vinyl resin particle dispersion liquid 1], the volume average particle diameter measured with a laser diffraction/scattering type particle size distribution measuring apparatus (LA-920, manufactured by HORIBA, Ltd.) was 110 nm. A part of the [vinyl resin particle dispersion liquid 1] was taken out and dried, and the resin component was isolated.

The vinyl resin had a weight average molecular weight (Mw) of 130,000 and a glass transition temperature (Tg) of 58° C.

(Preparation of Aqueous Phase)

990 parts by mass of water, 83 parts by mass of [vinyl resin particle dispersion liquid 1] obtained above, 37 parts by mass of 48.3% by mass of aqueous solution of sodium dodecyl diphenyl ether disulfonate (Eleminol (registered trademark) MON-7 manufactured by Sanyo Chemical Industries), and 90 parts by mass of ethyl acetate were mixed and stirred to obtain a milky white liquid. This is called "aqueous phase 1".

(Synthesis of Unmodified Polyester Resin 1)

724 parts by mass of bisphenol A ethylene oxide 2 mol adduct and 276 parts by mass of terephthalic acid were added to a reaction vessel equipped with a cooling tube, a stirrer, and a nitrogen inlet tube, polycondensed at 230° C. for 7 hours under atmospheric pressure, and further, reacted with the mixture under reduced pressure of 10 mmHg to 15 mmHg for 5 hours to obtain [unmodified polyester resin 1]. The weight average molecular weight (Mw) of the obtained unmodified polyester resin 1 was 6,700.

(Synthesis of Isocyanate Group-Containing Polyester Prepolymer 1)

682 parts by mass of bisphenol A ethylene oxide 2 mol adduct, 81 parts by mass of bisphenol A propylene oxide 2 mol adduct, 283 parts by mass of terephthalic acid, 22 parts by mass of trimellitic anhydride, and 2 parts by mass of dibutyltin oxide were added to a reaction vessel equipped with a cooling tube, a stirrer, and a nitrogen inlet tube, and the reaction was carried out under normal pressure at 230° C. for 7 hours and further reacted under reduced pressure of 10 mmHg to 15 mmHg for 5 hours to obtain [intermediate polyester resin 1].

410 parts by mass of the [intermediate polyester resin 1] obtained above, 89 parts by mass of isophorone diisocyanate, and 500 parts by mass of ethyl acetate were placed in a reaction vessel equipped with a condenser tube, a stirrer, and a nitrogen inlet tube, and the mixture was reacted at 100° C. for 5 hours to obtain [Isocyanate group-containing polyester prepolymer 1].

(Synthesis of Ketimine Compound 1)

170 parts by mass of isophorone diamine and 75 parts by mass of methyl ethyl ketone were charged in a reaction vessel equipped with a stirrer and a thermometer and reacted at 50° C. for 4.5 hours to obtain [ketimine compound 1].

(Preparation of Coloring Agent Master Batch 1)

800 parts by mass of water, coloring agent: 800 parts by mass of carbon black (Printex (registered trademark) 35 manufactured by Orion Engineered Carbons, DBP oil absorption amount=42 ml/100 mg, pH=9.5), and 1,200 parts by mass of unmodified polyester resin were added to a Henschel mixer (registered trademark, Nippon Coke & Engineering Co., Ltd.) and mixed. The resulting mixture was kneaded at 130° C. for 2 hours by using an open roll type kneader (Kneadex, manufactured by Nippon Coke & Engineering Co., Ltd.), rolled and cooled and pulverized with a pulverizer to obtain [coloring agent master batch 1]. In addition, water evaporated almost during kneading.

(Preparation of Coloring Agent and Release Agent Dispersion Liquid (Toner Material Liquid) 1)

300 parts by mass of [unmodified polyester resin 1], 350 parts by mass of paraffin wax (melting point: 70° C.) as a mold release agent, and 947 parts by mass of ethyl acetate were charged in a container equipped with a stirrer and a thermometer. The temperature was kept at 80° C. for 5 hours, and then cooled to 30° C. for 1 hour. Next, 500 parts by mass of [coloring agent master batch 1], 34.8 parts by mass of organically modified montmorillonite which is a layered silicate compound (Clayton (registered trademark) APA, manufactured by Southern Clay Products Co., Ltd., organic cationic modifier: quaternary alkyl ammonium salt), and 500 parts by mass of ethyl acetate were charged and charged to the container and mixed for 1 hour to obtain [raw material solution 1].

1,700 parts by mass of [raw material solution 1] was transferred to a container, and the coloring agent and the release agent were dispersed under the condition of a sending rate 1 kg/hr, a disc peripheral speed 6 m/s, a filling 80% by volume of 0.5 mm zirconia beads, and 3 passes by using a beads mill (Ultra Visco Mill, manufactured by Imex Co., Ltd.). Next, 700 parts by mass of a 65% by mass ethyl acetate solution of [unmodified polyester resin 1] was added, and the mixture passed through a bead mill under the above conditions for 2 passes to obtain [coloring agent and release agent dispersion liquid 1].

(Emulsification to Solvent Removal)

749 parts by mass of the [coloring agent and release agent dispersion liquid 1] obtained above, 100 parts by mass of [isocyanate group-containing polyester prepolymer 1], and 2.9 parts by mass of [ketimine compound 1] were added to a container and were mixed by using T. K. Homomixer (manufactured by Primix Corporation), and 1,500 parts by mass of [water phase 1] was added to the vessel, and further, mixed at 15,900 rpm for 25 minutes by T.K. Homomixer to obtain [emulsified slurry 1].

[Emulsified slurry 1] was charged in a container equipped with a stirrer and a thermometer. After removing the solvent at 30° C. for 7 hours, the mixture was aged at 45° C. for 7 hours to obtain [dispersion slurry 1].

(Cleaning to Drying)

100 parts by mass of [dispersion slurry 1] was filtered under reduced pressure to obtain a filter cake;

(I) 100 parts by mass of ion exchanged water was added to the filter cake, and filtration was carried out after mixing with T.K. Homomixer;

(II) 100 parts by mass of 10% by mass sodium hydroxide aqueous solution was added to the filter cake obtained in the above (I), and filtration under reduced pressure was carried out after mixing with T. K. Homomixer;

(III) 100 parts by mass of 10% by mass hydrochloric acid was added to the filter cake obtained in the above (II), and filtration was carried out after mixing with T.K. Homomixer;

(IV) 300 parts by mass of ion-exchanged water was added to the filter cake obtained in (III) above, and filtration was performed twice after mixing with T.K. Homomixer, thereby obtaining [filter cake 1].

[Filter cake 1] was dried in a circulating air dryer at 45° C. for 48 hours and sieved with a mesh size of 75 μm to obtain [toner base particle 1]. After that, 1 part by mass of hydrophobic silica and 1 part by mass of hydrophobic titanium oxide were added to 100 parts by mass of [toner base particle 1], and mixed with a Henschel mixer (registered trademark) to obtain black toner 1.

Preparation of Cyan Toner 1

In the preparation of black toner 1, cyan toner 1 was prepared in the same manner, except that the coloring agent was changed to "C.I. Pigment Blue 15:3" and the amount of the layered silicate compound added was changed to 58.5 parts by mass. The cyan toner 1 had a volume average particle diameter of 5.0 μm and an average circularity of 0.956.

Preparation of Magenta Toner 1

In the preparation of black toner 1, magenta toner 1 was prepared in the same manner, except that the coloring agent was changed to "C.I. Pigment Red 122" and the addition amount of the layered silicate compound was changed to 27.2 parts by mass.

Preparation of Yellow Toner 1

In the preparation of black toner 1, yellow toner 1 was prepared in the same manner, except that the coloring agent was changed to "C.I. Pigment Yellow 74" and the addition amount of the layered silicate compound was changed to 13.4 parts by mass.

(Preparation of Black Toners 2 to 18, Cyan Toners 2 to 18, Magenta Toners 2 to 18, Yellow Toners 2 to 18)

In the preparation of black toner 1, cyan toner 1, magenta toner 1, and yellow toner 1, the addition amount of layered silicate compound was changed to the amounts shown in Table 1 below. In addition, in toner set 7 (black toner 7, cyan toner 7, magenta toner 7, yellow toner 7), toner set 8 (black toner 8, cyan toner 8, magenta toner 8, yellow toner 8), toner set 13 (black toner 13, cyan toner 13, magenta toner 13, yellow toner 13), and toner set 16 (black toner 16, cyan toner 16, magenta toner 16, and yellow toner 16), the addition amount of sodium dodecyl diphenyl ether disulfonate in the above (preparation of aqueous phase) and the rotation number of homomixer in the above (emulsification to desolvation) were changed as follows.

(Preparation of Toner Set 7)

The addition amount of 48.3% by mass aqueous solution of sodium dodecyl diphenyl ether disulfonate was changed to 31 parts by mass and the rotation number of homomixer in (emulsification to desolvation) was changed to 13,000 rpm.

(Preparation of Toner Set 8)

The addition amount of 48.3% by mass aqueous solution of sodium dodecyl diphenyl ether disulfonate was changed to 46 parts by mass and the rotation number of homomixer in (emulsification to desolvation) was changed to 19,800 rpm.

(Preparation of Toner Set 13)

The addition amount of 48.3% by mass aqueous solution of sodium dodecyl diphenyl ether disulfonate was changed to 32 parts by mass and the rotation number of homomixer in (emulsification to desolvation) was changed to 22,700 rpm.

(Preparation of Toner Set 16)

The addition amount of 48.3% by mass aqueous solution of sodium dodecyl diphenyl ether disulfonate was changed to 17 parts by mass and the rotation number of homomixer in (emulsification to desolvation) was changed to 12,200 rpm.

In this way, black toners 2 to 18, cyan toners 2 to 18, magenta toners 2 to 18, and yellow toners 2 to 18 were prepared.

TABLE 1

| | Addition amount of layered silicate compound (parts by mass) | | | |
|---|---|---|---|---|
| Toner No. | Black toner | Cyan toner | Magenta toner | Yellow toner |
| Toner 1 | 34.8 | 58.5 | 27.2 | 13.4 |
| Toner 2 | 33.8 | 56.3 | 26.2 | 4.2 |
| Toner 3 | 19.1 | 45.4 | 20.2 | 4.1 |
| Toner 4 | 20.5 | 45.5 | 20.5 | 10.2 |
| Toner 5 | 50.3 | 71.4 | 34.0 | 22.6 |
| Toner 6 | 40.2 | 71.5 | 30.4 | 16.1 |
| Toner 7 | 33.5 | 50.3 | 25.1 | 5.0 |
| Toner 8 | 56.5 | 76.0 | 36.5 | 31.0 |
| Toner 9 | 20.1 | 56.3 | 20.1 | 4.0 |
| Toner 10 | 61.1 | 86.4 | 38.7 | 33.7 |
| Toner 11 | 32.2 | 46.6 | 21.0 | 4.2 |
| Toner 12 | 19.2 | 51.3 | 22.7 | 8.4 |
| Toner 13 | 43.6 | 64.4 | 30.5 | 10.1 |
| Toner 14 | 32.6 | 32.2 | 32.6 | 29.3 |
| Toner 15 | 25.1 | 61.5 | 30.7 | 27.7 |

TABLE 1-continued

| Toner No. | Addition amount of layered silicate compound (parts by mass) | | | |
|---|---|---|---|---|
| | Black toner | Cyan toner | Magenta toner | Yellow toner |
| Toner 16 | 65.6 | 84.1 | 40.7 | 22.4 |
| Toner 17 | 53.6 | 89.4 | 32.2 | 16.1 |
| Toner 18 | 21.6 | 33.5 | 18.9 | 7.5 |

Preparation of Carrier

As the core material particles, 100 parts by mass of Mn—Mg ferrite particles having a volume average particle diameter (median diameter based on volume) of 30 μm, a shape factor (SF-1) of 130, and a saturation magnetization of $8.2\times10^{-5}$ Wb·m/kg and 4 parts by mass of methacrylate resin particles (cyclohexyl methacrylate:methyl methacrylate=5:5 (mass ratio)) were charged into a high-speed stirring mixer equipped with a stirring blade, and after mixing and stirring at room temperature (25° C.) for 15 minutes, the mixture was mixed at 120° C. for 50 minutes to prepare a resin-coated carrier.

Production of Developer 100 parts by mass of the resin-coated carrier obtained above and 6 parts by mass of each color toner were mixed in a V-type mixer for 5 minutes to prepare two-component developers 1 to 18 of the respective colors.

Examples 1 to 12, Comparative Examples 1 to 6

The evaluation was carried out by using a two-component developer set (toner set) shown in Table 2 below.

[Evaluation]

<Volume Average Particle Diameter of Toner (Median Diameter Based on Volume)>

Measurement and calculation were performed by using a device connected to a computer system (manufactured by Beckman Coulter, Inc.) equipped with a data processing software "Software V 3.51" on a Coulter Counter Multisizer 3 (manufactured by Beckman Coulter, Inc.).

As a measurement procedure, first, 0.02 g of the toner was made to be compatible with 20 ml of the surfactant solution (For the purpose of improving the dispersibility of the toner, the surfactant solution was, for example, a neutral detergent containing a surfactant component diluted with pure water 10 times). After that, ultrasonic dispersion was performed for 1 minute to prepare a toner dispersion liquid. This toner dispersion liquid was injected into a beaker containing ISOTON II (manufactured by Beckman Coulter, Inc.) in a sample stand with a pipette until a measuring instrument display concentration became 5% to 10%. With this concentration range, reproducible measured values are obtained. In the measurement instrument, the number of measurement particles counted was set at 25,000, the aperture diameter was set to 100 μm, the frequency range was calculated by dividing the measurement range of 2.0 μm to 60 μm into 256, and the particle diameter of 50% was defined as the volume-based median diameter (volume D 50% diameter) from the side having the larger volume integral fraction.

The average value of the volume average particle diameters of the four color toners contained in one toner set is

TABLE 2

| | Two-component developer set No. (Toner set No.) | Black developer No. (Black toner No.) | Cyan developer No. (Cyan toner No.) | Magenta developer No. (Magenta toner No.) | Yellow developer No. (Yellow Toner No.) |
|---|---|---|---|---|---|
| Example 1 | Two-component developer set 1 (Toner set 1) | Black developer 1 (Black toner 1) | Cyan developer 1 (Cyan toner 1) | Magenta developer 1 (Magenta Toner 1) | Yellow developer 1 (Yellow Toner 1) |
| Example 2 | Two-component developer set 2 (Toner set 2) | Black developer 2 (Black toner 2) | Cyan developer 2 (Cyan toner 2) | Magenta developer 2 (Magenta Toner 2) | Yellow developer 2 (Yellow Toner 2) |
| Example 3 | Two-component developer set 3 (Toner set 3) | Black developer 3 (Black toner 3) | Cyan developer 3 (Cyan toner 3) | Magenta developer 3 (Magenta Toner 3) | Yellow developer 3 (Yellow Toner 3) |
| Example 4 | Two-component developer set 4 (Toner set 4) | Black developer 4 (Black toner 4) | Cyan developer 4 (Cyan toner 4) | Magenta developer 4 (Magenta Toner 4) | Yellow developer 4 (Yellow Toner 4) |
| Example 5 | Two-component developer set 5 (Toner set 5) | Black developer 5 (Black toner 5) | Cyan developer 5 (Cyan toner 5) | Magenta developer 5 (Magenta Toner 5) | Yellow developer 5 (Yellow Toner 5) |
| Example 6 | Two-component developer set 6 (Toner set 6) | Black developer 6 (Black toner 6) | Cyan developer 6 (Cyan toner 6) | Magenta developer 6 (Magenta Toner 6) | Yellow developer 6 (Yellow Toner 6) |
| Example 7 | Two-component developer set 7 (Toner set 7) | Black developer 7 (Black toner 7) | Cyan developer 7 (Cyan toner 7) | Magenta developer 7 (Magenta Toner 7) | Yellow developer 7 (Yellow Toner 7) |
| Example 8 | Two-component developer set 8 (Toner set 8) | Black developer 8 (Black toner 8) | Cyan developer 8 (Cyan toner 8) | Magenta developer 8 (Magenta Toner 8) | Yellow developer 8 (Yellow Toner 8) |
| Example 9 | Two-component developer set 9 (Toner set 9) | Black developer 9 (Black toner 9) | Cyan developer 9 (Cyan toner 9) | Magenta developer 9 (Magenta Toner 9) | Yellow developer 9 (Yellow Toner 9) |
| Example 10 | Two-component developer set 10 (Toner set 10) | Black developer 10 (Black toner 10) | Cyan developer 10 (Cyan toner 10) | Magenta developer 10 (Magenta Toner 10) | Yellow developer 10 (Yellow Toner 10) |
| Example 11 | Two-component developer set 11 (Toner set 11) | Black developer 11 (Black toner 11) | Cyan developer 11 (Cyan toner 11) | Magenta developer 11 (Magenta Toner 11) | Yellow developer 11 (Yellow Toner 11) |
| Example 12 | Two-component developer set 12 (Toner set 12) | Black developer 12 (Black toner 12) | Cyan developer 12 (Cyan toner 12) | Magenta developer 12 (Magenta Toner 12) | Yellow developer 12 (Yellow Toner 12) |
| Comparative Example 1 | Two-component developer set 13 (Toner set 13) | Black developer 13 (Black toner 13) | Cyan developer 13 (Cyan toner 13) | Magenta developer 13 (Magenta toner 13) | Yellow developer 13 (Yellow Toner 13) |
| Comparative Example 2 | Two-component developer set 14 (Toner set 14) | Black developer 14 (Black toner 14) | Cyan developer 14 (Cyan toner 14) | Magenta developer 14 (Magenta toner 14) | Yellow developer 14 (Yellow Toner 14) |
| Comparative Example 3 | Two-component developer set 15 (Toner set 15) | Black developer 15 (Black toner 15) | Cyan developer 15 (Cyan toner 15) | Magenta developer 15 (Magenta toner 15) | Yellow developer 15 (Yellow Toner 15) |
| Comparative Example 4 | Two-component developer set 16 (Toner set 16) | Black developer 16 (Black toner 16) | Cyan developer 16 (Cyan toner 16) | Magenta developer 16 (Magenta toner 16) | Yellow developer 16 (Yellow Toner 16) |
| Comparative Example 5 | Two-component developer set 17 (Toner set 17) | Black developer 17 (Black toner 17) | Cyan developer 17 (Cyan toner 17) | Magenta developer 17 (Magenta toner 17) | Yellow developer 17 (Yellow Toner 17) |
| Comparative Example 6 | Two-component developer set 18 (Toner set 18) | Black developer 18 (Black toner 18) | Cyan developer 18 (Cyan toner 18) | Magenta developer 18 (Magenta toner 18) | Yellow developer 18 (Yellow Toner 18) |

shown in Table 3 below. The standard deviation of the average value of the volume average particle diameter was within 0.3 in all Examples and Comparative Examples.

<Net Intensity Value of Aluminum Element by Wavelength Dispersive X-Ray Spectroscopy>

The measurement of the Net intensity value of the aluminum element in the toner was performed by using a fluorescent X-ray analyzer "XRF-1700" (manufactured by Shimadzu Corporation). Specifically, 2 g of the sample was pressurized to form pellets, and the measurement was carried out under the following conditions by qualitative quantitative analysis. For the measurement, the Kα peak angle of the aluminum element was determined from the 2θ table and used;

X-ray generator condition/target Rh, tube voltage 40 kV, tube current 95 mA, no filter Spectroscopic condition/slit standard, without attenuator, spectroscopic crystal (Al=PET), detector (Al=FPC).

<Toner Charge Quantity (Q)>

A commercially available copying machine "bizhub PRO (registered trademark) C6500" (manufactured by Konica Minolta Co., Ltd.) was prepared, and the two-component developer set prepared above was sequentially loaded, and 500,000 sheets were printed. For printing, a character image with a printing ratio of 3% was printed on A4 size transfer paper at 500,000 sheets in an environment of normal temperature and normal humidity (20° C., 50% RH).

The charge amount at the time of initial printing (tenth print, the same applies hereinafter) and the charge amount after 500,000 prints were finished was determined by the following blow-off method.

Using a blow-off charge quantity measuring apparatus "TB-200 (manufactured by Toshiba Chemical Co., Ltd.)", a component developing agent to be measured was set in the above-mentioned blow-off charge quantity measuring apparatus equipped with a 400 mesh stainless steel screen and blown with nitrogen gas for 10 seconds under the condition of blow pressure 50 kPa, and charge was measured. The charge (μC/g) was calculated by dividing the measured charge by the flying toner mass. The items in Table 3 below were calculated by the following method.

<<YMCK Average Q (Unit: μC/g)>>

The average value of the charge amounts of the black toner, the cyan toner, the magenta toner, and the yellow toner was obtained at the initial printing and after completion of printing of 500,000 sheets (after 500 kp). When the average value of the charge amount is in the range of 25 to 55 μC/g, the developability and the transferability of the toner become favorable.

<<Inter-CK ΔQ (Unit: μC/g)>>

The absolute value of the difference between the charge amounts of the cyan toner and the black toner at the initial printing was calculated. As the value is smaller, the difference in developability and transferability between the cyan toner and the black toner is smaller.

<<ΔQ (Unit: μC/g)>>

At the initial printing and after completion of printing of 500,000 sheets (after 500 kp), the toner charge amounts of the respective colors were obtained, and the difference between the maximum charge amount and the minimum charge amount was determined among them. When ΔQ is 15 μC/g or less, the difference in charge amount between the toners of the respective colors is small, and the difference in developability and transferability between the toners of the respective colors is reduced, which indicates that it can be practically used. When ΔQ is less than 10 μC/g, it indicates that the difference in developability and transferability between the toners of the respective colors is further reduced.

<Scattering of Toner>

In an environment of normal temperature and normal humidity (20° C., 50% RH), the toner scattering amount after completion of printing of 500,000 sheets was measured as follows. 2 g of the two-component developer weighed with a precision balance was placed on the entire surface of the conductive sleeve so as to be uniform, and a cylindrical electrode was placed on the conductive sleeve. The toner is left on the cylindrical electrode for 30 seconds with the rotational speed of the magnet roll provided in the conductive sleeve set at 2,400 rpm, and the collected toner mass (collected toner amount (A)) is precisely measured with a balance. Next, the conductive sleeve was covered with the same cylindrical electrode again, a voltage of 4 kV was supplied from the bias power source to the sleeve, the rotation number of the magnet roll was rotated to 2,400 rpm in the same manner, and the magnet roll was allowed to stand for 30 seconds, and the mass of collected toner (amount of collected toner (B)) collected on the cylindrical electrode was measured with a precision balance. From the obtained values, the toner scattering amount was calculated according to the following formula and evaluated according to the following evaluation criteria. A to C are practically usable;

$$\text{Toner scattering amount (\%)} = (\text{collected toner amount}(A)/\text{collected toner amount}(B)) \times 100.$$

Evaluation Criteria for Toner Scattering Amount

A: Less than 5%

B: 5% or more and less than 10%

C: 10% or more and less than 15%

D: 15% or more.

<Variation Width of ΔE*Ab>

A solid image (2 cm×2 cm) of green (G), red (R), and blue was produced at the initial printing and after completion of printing of 500,000 sheets. The solid image was measured with a spectrophotometer, expressed in the L*a*b* color system, and ΔE*ab was determined from the measured value. The "L*a*b*color system" is a means which is usefully used to represent colors numerically, the L* axis direction indicates brightness, the a* axis direction indicates the hue in the red-green direction, and the b* axis direction indicates the hue in the yellow-blue direction. L*, a*, and b* was measured under condition of using a spectrophotometer "Gretag Macbeth Spectrolino" (manufactured by Gretag Macbeth Co.), using a D65 light source as a light source, using a reflection measurement aperture of φ4 mm, setting a viewing angle to 2° at a measurement wavelength band of 380 nm to 730 nm by 10 nm, and using an exclusive white tile for reference adjustment.

The change width of ΔE*ab of the image in the initial printing and the image after printing of 500,000 sheets was evaluated according to the following criteria. If the change width of ΔE*ab was 5.0 or less, the color reproducibility was acceptable, and among them, it was determined that the color reproducibility was good if it was 3.0 or less;

Change Range of ΔE*ab Evaluation Criteria

A: 3.0 or less

B: more than 3.0 and 4.0 or less

C: more than 4.0 and 5.0 or less

D: Level exceeding 5.0, problematic level in practical use.

The Net intensity value of the aluminum element of each color toner is shown in Table 3 below and various evaluation results are shown in Table 4 below.

TABLE 3

| | Average value of volume average particle diameters of four color toners (μm) | Net intensity value of aluminum (kcps) | | | | | | Ratio of Net intensity aluminum | | | | | |
|---|---|---|---|---|---|---|---|---|---|---|---|---|---|
| | | Yellow Al (Y) | Magenta Al (M) | Cyan Al (C) | Black Al (K) | Al (C) − Al (Y) | Al (C) − Al (K) | Al (Y)/ Al (M) | Al (Y)/ Al (C) | Al (Y)/ Al (K) | Al (C)/ Al (M) | Al (K)/ Al (M) | Al (K)/ Al (C) |
| Example 1 | 5.0 | 1.60 | 3.24 | 6.97 | 4.15 | 5.37 | 2.83 | 0.4940 | 0.2294 | 0.3857 | 2.153 | 1.281 | 0.595 |
| Example 2 | 5.0 | 0.50 | 3.13 | 6.72 | 4.03 | 6.22 | 2.69 | 0.1600 | 0.0744 | 0.1240 | 2.151 | 1.290 | 0.600 |
| Example 3 | 4.9 | 0.49 | 2.42 | 5.41 | 2.28 | 4.92 | 3.14 | 0.2034 | 0.0907 | 0.2156 | 2.241 | 0.943 | 0.421 |
| Example 4 | 4.9 | 1.22 | 2.44 | 5.42 | 2.44 | 4.20 | 2.98 | 0.5000 | 0.2250 | 0.5000 | 2.222 | 1.000 | 0.450 |
| Example 5 | 5.2 | 2.70 | 4.06 | 8.52 | 6.00 | 5.82 | 2.52 | 0.6657 | 0.3169 | 0.4497 | 2.101 | 1.480 | 0.705 |
| Example 6 | 5.1 | 1.92 | 3.62 | 8.53 | 4.80 | 6.61 | 3.73 | 0.5300 | 0.2250 | 0.4000 | 2.356 | 1.325 | 0.563 |
| Example 7 | 5.9 | 0.60 | 3.00 | 6.00 | 4.00 | 5.40 | 2.00 | 0.2000 | 0.1000 | 0.1500 | 2.000 | 1.333 | 0.600 |
| Example 8 | 4.1 | 3.70 | 4.35 | 9.07 | 6.74 | 5.37 | 2.33 | 0.8500 | 0.4080 | 0.5492 | 2.083 | 1.548 | 0.743 |
| Example 9 | 4.9 | 0.48 | 2.40 | 6.71 | 2.40 | 6.23 | 4.31 | 0.2000 | 0.0715 | 0.2000 | 2.797 | 1.000 | 0.358 |
| Example 10 | 5.3 | 4.02 | 4.62 | 10.31 | 7.29 | 6.29 | 3.02 | 0.8700 | 0.3900 | 0.5517 | 2.231 | 1.577 | 0.707 |
| Example 11 | 5.0 | 0.50 | 2.50 | 5.56 | 3.85 | 5.06 | 1.71 | 0.2000 | 0.0900 | 0.1300 | 2.222 | 1.538 | 0.692 |
| Example 12 | 4.9 | 1.00 | 2.70 | 6.12 | 2.29 | 5.12 | 3.83 | 0.3700 | 0.1633 | 0.4358 | 2.266 | 0.849 | 0.375 |
| Comparative Example 1 | 3.6 | 1.20 | 3.64 | 7.69 | 5.20 | 6.49 | 2.48 | 0.3300 | 0.1561 | 0.2307 | 2.114 | 1.431 | 0.677 |
| Comparative Example 2 | 5.0 | 3.50 | 3.89 | 3.85 | 3.89 | 0.35 | 0.04 | 0.9000 | 0.9100 | 0.9000 | 0.989 | 1.000 | 1.011 |
| Comparative Example 3 | 5.1 | 3.30 | 3.67 | 7.33 | 3.00 | 4.03 | 4.33 | 0.9000 | 0.4500 | 1.1000 | 2.000 | 0.818 | 0.409 |
| Comparative Example 4 | 6.5 | 2.67 | 4.85 | 10.03 | 7.83 | 7.36 | 2.20 | 0.5500 | 0.2662 | 0.3411 | 2.066 | 1.612 | 0.780 |
| Comparative Example 5 | 5.2 | 1.92 | 3.84 | 10.67 | 6.40 | 8.75 | 4.27 | 0.5000 | 0.1800 | 0.3000 | 2.778 | 1.667 | 0.600 |
| Comparative Example 6 | 4.9 | 0.90 | 2.25 | 4.00 | 2.57 | 3.10 | 1.43 | 0.4000 | 0.2250 | 0.3500 | 1.778 | 1.143 | 0.643 |

TABLE 4

| | YMCK average Q (μC/g) | | Inter-CK ΔQ (μC/g) | Δ Q (μC/g) | | Toner scattering | Change width of ΔE*ab | | |
|---|---|---|---|---|---|---|---|---|---|
| | Initial | After 500 kp | Initial | Initial | After 500 kp | | G | R | B |
| Example 1 | 45.1 | 37.6 | 1.1 | 1.5 | 3.9 | A | A | A | A |
| Example 2 | 48.4 | 39.0 | 1.9 | 9.1 | 13.8 | A | C | C | A |
| Example 3 | 55.0 | 48.5 | 0.8 | 2.5 | 4.8 | A | A | A | A |
| Example 4 | 53.1 | 44.3 | 1.6 | 6.4 | 10.8 | A | B | B | A |
| Example 5 | 35.3 | 26.9 | 1.2 | 1.3 | 3.1 | B | A | A | A |
| Example 6 | 39.9 | 28.4 | 7.1 | 7.8 | 13.5 | B | B | A | B |
| Example 7 | 41.1 | 31.3 | 1.5 | 8.7 | 12.9 | A | B | B | A |
| Example 8 | 36.9 | 28.1 | 1.3 | 5.8 | 8.4 | B | B | B | A |
| Example 9 | 52.8 | 43.3 | 7.9 | 8.5 | 13.7 | A | C | A | C |
| Example 10 | 26.1 | 19.6 | 5.1 | 4.9 | 8.5 | C | A | B | A |
| Example 11 | 52.4 | 44.0 | 8.1 | 7.5 | 11.5 | A | A | A | A |
| Example 12 | 51.9 | 43.6 | 4.6 | 5.0 | 8.8 | A | A | A | A |
| Comparative Example 1 | 60.4 | 52.3 | 2.1 | 10.9 | 15.2 | A | D | D | A |
| Comparative Example 2 | 44.2 | 30.6 | 19.1 | 28.5 | 36.9 | B | D | C | D |
| Comparative Example 3 | 41.0 | 29.3 | 9.0 | 22.9 | 28.9 | B | D | D | B |
| Comparative Example 4 | 21.6 | 15.1 | 1.3 | 8.5 | 19.4 | D | D | D | D |
| Comparative Example 5 | 33.7 | 19.6 | 11.8 | 21.2 | 28.5 | C | D | D | D |
| Comparative Example 6 | 56.4 | 47.6 | 11.5 | 13.2 | 18.0 | A | D | B | B |

As is apparent from the results in Table 4 above, according to the image forming method (toner set for electrostatic latent image development) of the example, it was found that the difference in charge amount between the respective color toners at the initial use and the long-term use was reduced and the color reproducibility of the color image at the time of long-term use was improved.

Although embodiments of the present invention have been described in detail, the disclosed embodiments are made for the purpose of example only and not limitation.

The scope of the present invention should be interpreted by terms of the appended claims.

What is claimed is:

1. An image forming method using a color toner including a yellow toner, a magenta toner, a cyan toner, and a black toner, the method comprising:

a toner image forming step of forming a toner image by developing the color toner on an electrostatic latent image formed by charging and exposing a surface of an electrostatic latent image bearing member;

a transfer step of transferring the toner image onto a recording medium to form a color toner image; and a fixing step of fixing the color toner image on the recording medium, wherein the yellow toner, the magenta toner, the cyan toner, and the black toner each contain at least a binder resin, a coloring agent, a release agent, and a layered silicate compound, a volume average particle diameter of the yellow toner, the magenta toner, the cyan toner and the black toner is 4 μm to 6 μm, and wherein Al (Y) kcps is a content of aluminum element in the yellow toner expressed by Net intensity by wavelength dispersion type fluorescent X-ray analysis, Al (M) kcps is a content of aluminum element in the magenta toner expressed by Net intensity by wavelength dispersion type fluorescent X-ray analysis, Al (C) kcps is a content of aluminum element in the cyan toner expressed by Net intensity by wavelength dispersion type fluorescent X-ray analysis, and Al (K) kcps is a content of aluminum element in the black toner expressed by Net intensity by wavelength dispersion type fluorescent X-ray analysis, and the following Formulae (1) to (10) are satisfied by Al (Y), Al (M), Al (C), and Al (K), $$Al(Y)<Al(M)<Al(C) \quad (1)$$

$$Al(Y)<Al(K)<Al(C) \quad (2)$$

$$3.18<[Al(C)-Al(Y)]<8.65 \quad (3)$$

$$0.49<Al(Y)<3.85 \quad (4)$$

$$2.41<Al(M)<4.91 \quad (5)$$

$$5.41<Al(C)<10.14 \quad (6)$$

$$2.27<Al(K)<7.94 \quad (7)$$

$$0.1001<[Al(Y)/Al(M)]<1 \quad (8)$$

$$0.0484<[Al(Y)/Al(C)]<0.7105 \quad (9)$$

$$0.0618<[Al(Y)/Al(K)]<1 \quad (10), \text{ and}$$

ΔQ for each toner is 15 μC/g or less, at initial printing and after printing 500,000 sheets, where ΔQ is the difference between a maximum charge amount and a minimum charge amount.

2. The image forming method as claimed in claim 1, wherein Al (Y), Al (M), Al (C), and Al (K) satisfy the following Formulae (11) to (15)

$$0.1513<[Al(Y)/Al(M)]<0.9436 \quad (11)$$

$$0.0703<[Al(Y)/Al(C)]<0.4494 \quad (12)$$

$$0.1179<[Al(Y)/Al(K)]<1 \quad (13)$$

$$2.040<[Al(C)/Al(M)]<2.390 \quad (14)$$

$$0.375<[Al(K)/Al(M)]<1.712 \quad (15).$$

3. The image forming method as claimed in claim 1, wherein Al (Y), Al (M), Al (C), and Al (K) satisfy the following Formulae (16) to (20)

$$0.1735<[Al(Y)/Al(M)]<0.8563 \quad (16)$$

$$0.0792<[Al(Y)/Al(C)]<0.4116 \quad (17)$$

$$0.1524<[Al(Y)/Al(K)]<0.5500 \quad (18)$$

$$2.051<[Al(C)/Al(M)]<2.314 \quad (19)$$

$$0.667<[Al(K)/Al(M)]<1.669 \quad (20).$$

4. The image forming method as claimed in claim 1, wherein Al (Y), Al (M), Al (C), and Al (K) satisfy the following Formulae (21) to (25)

$$0.2033<[Al(Y)/Al(M)]<0.7839 \quad (21)$$

$$0.0900<[Al(Y)/Al(C)]<0.3796 \quad (22)$$

$$0.2155<[Al(Y)/Al(K)]<0.4847 \quad (23)$$

$$2.064<[Al(C)/Al(M)]<2.242 \quad (24)$$

$$0.943<[Al(K)/Al(M)]<1.618 \quad (25).$$

5. The image forming method as claimed in claim 1, wherein Al (C) and Al (K) satisfy the following Formula (26)

$$1.72<[Al(C)-Al(K)]<3.41 \quad (26).$$

6. A toner set for developing an electrostatic latent image including a yellow toner, a magenta toner, a cyan toner, and a black toner, wherein the yellow toner, the magenta toner, the cyan toner, and the black toner each contain at least a binder resin, a coloring agent, a release agent, and a layered silicate compound, a volume average particle diameter of the yellow toner, the magenta toner, the cyan toner and the black toner is 4 μm to 6 μm, and when Al (Y) kcps is a content of aluminum element in the yellow toner expressed by Net intensity by wavelength dispersion type fluorescent X-ray analysis, Al (M) kcps is a content of aluminum element in the magenta toner expressed by Net intensity by wavelength dispersion type fluorescent X-ray analysis, Al (C) kcps is a content of aluminum element in the cyan toner expressed by Net intensity by wavelength dispersion type fluorescent X-ray analysis, and Al (K) kcps is a content of aluminum element in the black toner expressed by Net intensity by wavelength dispersion type fluorescent X-ray analysis, and the following Formulae (1) to (10) are satisfied by Al (Y), Al (M), Al (C), and Al (K), $$Al(Y)<Al(M)<Al(C) \quad (1)$$

$$Al(Y)<Al(K)<Al(C) \quad (2)$$

$$3.18<[Al(C)-Al(Y)]<8.65 \quad (3)$$

$$0.49<Al(Y)<3.85 \quad (4)$$

$$2.41<Al(M)<4.91 \quad (5)$$

$$5.41<Al(C)<10.14 \quad (6)$$

$$2.27<\mathrm{Al}(K)<7.94 \quad (7)$$

$$0.1001<[\mathrm{Al}(Y)/\mathrm{Al}(M)]<1 \quad (8)$$

$$0.0484<[\mathrm{Al}(Y)/\mathrm{Al}(C)]<0.7105 \quad (9)$$

$$0.0618<[\mathrm{Al}(Y)/\mathrm{Al}(K)]<1 \quad (10), \text{ and}$$

$\Delta Q$ for each toner is 15 μC/g or less, at initial printing and after printing 500,000 sheets, where $\Delta Q$ is the difference between a maximum amount charge amount and a minimum charge amount.

* * * * *